US009937992B2

(12) United States Patent
Kuribayashi et al.

(10) Patent No.: US 9,937,992 B2
(45) Date of Patent: Apr. 10, 2018

(54) STEERING DEVICE AND METHOD FOR STEERING THE SAME

(71) Applicants: KAY SEVEN CO., LTD., Tokyo (JP); Noriyuki Sasaki, Kanagawa (JP); NATIONAL INSTITUTE OF MARITIME, PORT AND AVIATION TECHNOLOGY, Tokyo (JP); YAMANAKA SHIPBUILDING CO., LTD., Ehime (JP); KAMOME PROPELLER CO., LTD., Kanagawa (JP)

(72) Inventors: Sadatomo Kuribayashi, Tokyo (JP); Noriyuki Sasaki, Kanagawa (JP)

(73) Assignees: KAY SEVEN CO., LTD., Tokyo (JP); Noriyuki Sasaki, Chigasaki-shi, Kanagawa (JP); NATIONAL INSTITUTE OF MARITIME, PORT AND AVIATION TECHNOLOGY, Tokyo (JP); YAMANAKA SHIPBUILDING CO., LTD., Imabari, Ehime (JP); KAMOME PROPELLER CO., LTD., Yokohama, Kanagawa (JP)

( * ) Notice: Subject to any disclaimer, the term of this patent is extended or adjusted under 35 U.S.C. 154(b) by 0 days.

(21) Appl. No.: 15/115,601

(22) PCT Filed: Nov. 19, 2014

(86) PCT No.: PCT/JP2014/080623
§ 371 (c)(1),
(2) Date: Oct. 13, 2016

(87) PCT Pub. No.: WO2015/114916
PCT Pub. Date: Aug. 6, 2015

(65) Prior Publication Data

US 2017/0081010 A1 Mar. 23, 2017

(30) Foreign Application Priority Data

Jan. 31, 2014 (JP) ..... 2014-017401
Mar. 14, 2014 (JP) ..... 2014-052040

(51) Int. Cl.
*B63H 25/06* (2006.01)
*B63H 25/38* (2006.01)
*B63H 5/15* (2006.01)

(52) U.S. Cl.
CPC ..... *B63H 25/38* (2013.01); *B63H 25/382* (2013.01); *B63H 25/383* (2013.01); *B63H 5/15* (2013.01); *B63H 2025/066* (2013.01)

(58) Field of Classification Search
CPC ..... B63H 25/38; B63H 25/382; B63H 25/383
See application file for complete search history.

(56) References Cited

U.S. PATENT DOCUMENTS 2,276,163 A 3/1942 Coolidge
2,916,005 A 12/1959 Parsons
(Continued)

FOREIGN PATENT DOCUMENTS

FR 1106851 A 12/1955
GB 2033324 A 5/1980
(Continued)

OTHER PUBLICATIONS

"Regarding Evaluation of Support for Technology Development for Curtailing CO2 from Marine Vessels", accompanying material "Regarding Evaluation of Support for Technology Development for Curtailing CO2 from Marine Vessels", Ministry of Land, Infrastructure, Transport and Tourism, Marine Bureau, Heisei 25 Year Mar. 29, 2013, 1-6 pgs.
(Continued)

*Primary Examiner* — Stephen P Avila
(74) *Attorney, Agent, or Firm* — Muncy, Geissler, Olds & Lowe, P.C.

(57) ABSTRACT

A steering device having two rudder plates vertically suspended at a distance from an outer edge of a propeller. The rudder plates are biaxially arranged and symmetrically rotate around a screw shaft within a propeller radius from a screw shaft center, on a propeller rotation plane, and are turned from aside the propeller to downstream of the propeller by rotation of the steering shafts, each of which is driven independently by two hydraulic driving mechanisms. The steering action of the steering device has two modes: the two-independent mode, where the plates rotate in the same direction, and the two-same direction modes, where the
(Continued)

plates move in different directions. A method for steering the same to enhance a thrust flow by increase in a propeller rate is also provided.

9 Claims, 26 Drawing Sheets

(56) References Cited

U.S. PATENT DOCUMENTS

| | | | | |
|---|---|---|---|---|
| 3,101,693 | A | 8/1963 | Schilling | |
| 3,872,817 | A | 3/1975 | Duryea | |
| 4,895,093 | A * | 1/1990 | Dalsbo | B63H 25/48 114/163 |
| 5,445,100 | A * | 8/1995 | Finkl | B63H 25/38 114/163 |

FOREIGN PATENT DOCUMENTS

| | | | |
|---|---|---|---|
| JP | 50-55094 | A | 5/1975 |
| JP | 56-64900 | U | 5/1981 |
| JP | 01-501384 | A | 5/1989 |
| JP | H02-151595 | A | 6/1990 |
| JP | 06-92240 | | 4/1994 |
| JP | 2010-13087 | A | 1/2010 |
| JP | 2011-73526 | A | 4/2011 |
| JP | 2014-73815 | A | 4/2014 |
| WO | WO 88/03891 | A1 | 6/1988 |

OTHER PUBLICATIONS

New Conception of New Steering Machine, Rudder System-Rotary Vane Steering Machine, Vec Twin Rudder System (2) Journal of the Japan Institute of Marine Engineering, vol. 45, No. 3, 2010, pp. 97-104.

New Conception of New Steering Machine, Rudder System-Rotary Vane Steering Machine, Vec Twin Rudder System (1) Journal of the Japan Institute of Marine Engineering, vol. 45, No. 2, 2010, pp. 93-99.

"Regarding Evaluation of Support for Technology Development for Curtailing CO2 from Marine Vessels", accompanying material "Regarding Evaluation of Support for Technology Development for Curtailing CO2 from Marine Vessels", Ministry of Land, Infrastructure, Transport and Tourism, Marine Bureau, Heisei 25 Year Mar. 29, 2013, 2 pages.

* cited by examiner

STEERING DEVICE AND METHOD FOR STEERING THE SAME

CROSS-REFERENCE TO RELATED APPLICATION

The present application claims the priorities based on Japanese Patent Application No. 2014-017401 "STEERING DEVICE" filed Jan. 31, 2014 and Japanese Patent Application No. 2014-052040 "STEERING DEVICE" filed Mar. 14, 2014, a content of which is incorporated herein by reference.

TECHNICAL FIELD

The present invention relates to a steering device which allows for high propulsive performance of marine vehicles due to saving of main engine fuel consumption during navigation of these vehicles (see, for example, Non-Patent Literature 1). More particularly, the invention is a steering mechanism which improves the conventional rudder behind a propeller to enhance the propulsive performance of the propeller. The mechanism also utilizes the rudder at the time of stopping, enhances the steering ability at a slow vessel speed, and reduces the underwater noise emitted by the propeller and the rudder. The present invention is suitable for effective water trafficking of ships by making use of rudder assisted steering of marine vehicles by using the method described in this application.

BACKGROUND ART

The conventional rudder is positioned in the slipstream of a propeller and hence by creating an additional resistant component. When a rudder is not disposed behind a propeller but to remain in the same lateral plane with the propeller, it is left to arrange the rudder aside or in front of the propeller. In view of interference with a propulsion shaft, configuration of two or more rudders must be taken. On the other hand, Non-Patent Literatures 2 and 3 pay an attention to the stopping ability, and propose the adoption of a single-shaft propulsion with twin rudders for ship handling. It is stated therein that, upon request of a sudden stop at emergency, the two rudders cooperate at a right angle to a hull by taking position behind the propeller to block its slipstream, and to provide the vessel with a powerful stopping ability. This way of steering and stopping technique is not much different from the prior art, in a point that the rudder still acts as a resistance component in the slip stream of a propeller. As the prior invention of twin rudder, there is the invention disclosed in Patent Literature 1. The same invention prioritizes improvement in propulsive performance due to such a rudder plate that "two rudder plates are arranged in front of or aside the propeller, and does not concentrate on the stopping ability. On the other hand, configuration having two steering shafts is also disclosed in FIG. 12 of Patent Literature 1, and since a rudder plate rotates around a steering shaft included in a rudder plate face, the rudder plate cannot take position behind the propeller slipstream and hence a problem arises in the steering ability, particularly, at a slow vessel speed. This is problematic for domestic vessels and patrol boats which cannot receive assistance of tugboats. When the number of rudders is 2, utilization of a camber comes in sight, but Patent Literature 2 is limited to use the effect of camber in a twin rudder arrangement in propeller slipstream. At a rudder angle of 90 degree, it becomes necessary to also contrive a steering shaft driving mechanism, and Patent Literature 3 proposes an oil hydraulic driving mechanism which enables a rudder angle near 180 degree, using a rotary vane. Patent Literature 4 describes the proposal that the effect of straightening a propeller slipstream in a region sandwiched by two rudders is exerted, and a high propulsive efficiency can be realized. However, in this latter arrangement, since the rudders are arranged at the slipstream of a propeller, it seems that there is a limitation in improvement of the propulsive performance. Inter alia, in domestic vessels, since the support by tugboats inside the bay will not be expected, the turning ability at the slow ship speeds should be maintained by own ship handling. In the case of the rudder arranged outside of the propeller slip stream aiming to only higher propulsive efficiency, the special attention should be paid to the movement of the rudder during the steering motion and also mechanism and a steering method are the same. An invention which recognizes or suggests a solution by discriminating at the time of slow speed navigation and at the time of cruising concerning steering in this case has not been found out. In this respect, as a method for steering two rudders, FIG. 4 of Patent Literature 5 presents a "method for displaying a moving direction for a system of two rudders". In this presentation the rudder position and a moving direction of a ship are displayed in ships having two rudders as such rudder arrangement of steering modes of (b) indicates forward right turning, and (e) right turning on the spot. However the present invention is not suggested by a positional relationship between a turning central position of two rudders and a propeller in propeller slipstream arrangement. In addition, there is proposed a ship in which two rudders are arranged on both sides of a propeller, for the purpose of shortening the length of the propeller and that of a stern rudder for expansion of space for a stein (Patent Literature 4). However, according to configuration shown in FIG. 8 of Patent Literature 4, it seems that there is limitation in a steering range, and it is difficult to create a deflected stream of a propeller slipstream.

PRIOR ART LITERATURES

Patent Literatures

[Patent Literature 1] JP-A-2014-73815
[Patent Literature 2] JP-A-50-55094
[Patent Literature 3] JP-A-2011-73526
[Patent Literature 4] JP-A-2010-13087
[Patent Literature 5] JP-B-6-92240

Non-Patent Literatures

[Non-Patent Literature 1]
https://www.mlit.go.jp/report/press/kaiji06_hh_000061.html
"Regarding Evaluation of Support for Technology Development for Curtailing $CO_2$ from Marine Vessels", accompanying material "Regarding Evaluation of Support for Technology Development for Curtailing $CO_2$ from Marine Vessels", Ministry of Land, Infrastructure, Transport and Tourism, Marine Bureau, Heisei 25 Year (2013) Mar. 29
[Non-Patent Literature 2] New Conception of New Steering Machine Rudder System-Rotary Vane Steering Machine, Vec Twin Rudder System (2) Journal of the Japan Institute of Marine Engineering, vol. 45, No. 3, P97-104

[Non-Patent Literature 3] New Conception of New Steering Machine Rudder System-Rotary Vane Steering Machine, Vec Twin Rudder System (1) Journal of the Japan Institute of Marine Engineering, vol. 45, No. 2, P93-99

SUMMARY OF THE INVENTION

Problems to be Solved by the Invention

As shown above, many attempts have been made for a contrivance to improve the propulsion performance of ships using the single-shaft and single rudder combination but these attempts had limited impact on the propulsion performance under the restricted condition of the same configuration. There is also contrivance for maintaining turning performance under configuration of twin-shaft propulsion, but there is a problem in regards to the cost of additional engine requirement. There is also contrivance for supplementing decrease in performance generated from shape modification while maintaining turning performance by contrivance of a rudder shape, but there is limitation in improvement in cruising propulsion performance of mainly traveling straight. A Kort nozzle which eliminates the need for a dedicated rudder at a stern has a problem in a point of propulsive efficiency performance. By simple arrangement of a rudder on both sides of a propeller, higher propulsive performance than before is obtained, but it is insufficient for pursuing high turning performance. The present invention is a new rudder and arrangement system offering a universal rudder of an era and propeller system for merchant ships which can provide a fast water stream utilizing a fossil fuel.

A new rudder is expected to save a fossil fuel consumption amount and a $CO_2$ generation amount due to improvement in propulsive performance, and maintain high turning performance and the stopping ability at emergency.

Then, at the time of straight cruising, it is preferable that the rudder is not positioned in the propeller slipstream, and at the time of emergency stopping it is preferable that the rudder is positioned in the propeller slipstream and can be steered until a right angle to a ship hull, and a turning mechanism realizing a rudder angle of 90 degree is preferable.

Even when the rudder is not positioned in the slipstream of a propeller, it is required to deflect the propeller slip stream to maintain the turning ability.

The present invention was done in view of the aforementioned problems, and an object thereof is to provide a steering device in which, in order to enhance a propulsion efficiency of a propeller at the time of straight cruising, a rudder is not positioned in the propeller slipstream. At the time of emergency stopping, a rudder angle of 90 degree to the ship hull enables the propeller slipstream to deflect to assist stopping and then back to straight position for turning to maintain turning performance.

For a new rudder, arrangement and movement of the rudder at the time of veering are further elaborated, a problem of maintaining turning performance at a slow speed is recognized, and inconvenience of not disposing the rudder at the propeller slipstream is solved, and this is also a steering device and a steering procedure of the present invention.

Means to Solve the Problems

The present invention solving this problem is as follows.

A steering device having a driving mechanism rotating a steering shaft, and a power mechanism driving this, wherein the steering shaft is biaxially arranged to rotate on both sides of a screw shaft upper portion, each steering shaft connects and suspends a rudder plate from the upper portion of the rudder plate, and two rudder plates can turn from aside of a propeller to a downstream of the propeller by rotating two steering shafts.

[The Operational Advantage of the Invention]

In the invention, the steering shaft is biaxially arranged to rotate on both sides of a screw shaft upper portion, the steering shaft connects and suspends a rudder plate from the upper portion of the rudder plate, and a power mechanism such as an electric servomotor or a hydraulic cylinder turns two rudders from aside of a propeller to a downstream of the propeller by rotation of two steering shafts via a driving mechanism. At the time of direct cruising, since two rudders are arranged on both sides of the propeller parallel with a ship longitudinal axis, and do not hinder a propeller slip stream, higher propulsive performance can be provided as compared with the propeller arrangement of the conventional technology. Since two rudders are arranged on both sides of the propeller, and the narrower and smaller rudder can be used for each rudder as compared with the conventional single rudder configuration, and the rudder receives a smaller fluid viscous resistance, and therefore, a high propulsive efficiency is obtained. It is preferable that the smaller rudder herein has a length of about a half of that of the case of single rudder configuration in terms of a rudder length. At the time of steering, since two steering shafts are used, dedicated steering shafts are disposed for two rudder plates, and two rudder plates are turned from aside of the propeller to the downstream of the propeller by the rotation of two steering shafts. By this arrangement the turning radius can be smaller, two rudder plates and a rear end of the propeller are brought close to each other, and a deflected propeller slipstream can be generated at a large rudder angle to realize a high turning performance. Herein, it is preferable that a smaller turning radius is, for example, such that the turning radius is around a half of a propeller radius.

A power mechanism of the invention may be a hydraulic cylinder in which two steering shafts are rotated by a cylinder shaft. This shaft is driven linearly by a hydraulic cylinder which is reciprocated by an oil pressure and crank mechanism which converts a reciprocating linear motion into a rotation motion. Alternatively the power mechanism may be a hydraulic cylinder constructed of a bevel gear which is attached to the steering shaft and can rotate the steering shaft together with rotation, and a bevel gear mechanism which converts a rotational plane from horizontal into vertical, Here, the power mechanism is an electric servomotor or a hydraulic motor mechanism, or when the electric servomotor mechanism or the hydraulic motor mechanism is a vertical type, the steering shaft is directly driven with the hydraulic motor, and the gear mechanism may be omitted.

The power mechanism of the invention is a hydraulic cylinder and the driving mechanism thereof comprises a rotation driven mechanism freely rotating the two steering shafts by a cylinder shaft and crank mechanism which are reciprocation-driven by a hydraulic cylinder being reciprocated preferably by oil pressure, and in this case, two rudder plates arranged on both sides of the propeller at the time of direct cruising turn around the propeller with two steering shafts being reciprocation-rotated by the cooperation of a cylinder shaft and a crank mechanism. This mechanism is reciprocation-driven linearly with a hydraulic cylinder being reciprocated by an oil pressure, and a rudder angle seen from its ship axis is changed. By rotation of the steering shaft of this driving mechanism, one of two rudders is moved into the propeller slipstream, thereby, a more deflected slipstream can be produced, and the effect of providing high turning performance is obtained, as compared with the case where the rudder plate is rotated around a shaft on a rudder plate on both sides of the propeller to obtain a rudder angle. Such simplicity is obtained that when a straight motion is converted into a rotational motion by a crank mechanism to rotate two steering shafts using a hydraulic device which is normally mounted in a ship as a power source, a steering device mechanism may be on an extended line of the previous mechanism, and the economical property is excellent. In a configuration that two steering shafts are rotated in conjunction by a linking crank mechanism, since two rudder plates synchronously turn around the propeller, there is also an advantage that a steering control mechanism may be simple.

The steering device, in which the power mechanism of the invention is an electric servomotor or a hydraulic motor mechanism, and the driving mechanism thereof is a bevel, gear which is attached to the steering shaft and can rotate the steering shaft together with rotation, and a bevel gear mechanism which converts a rotation plane between vertical and horizontal is also preferable, and in this case, at the time of straight cruising, when the electric servomotor mechanism or the hydraulic motor mechanism is driven, a rudder angle can be independently changed together with the steering shaft which is rotation-driven with the bevel gear mechanism, to turn rudder plates arranged on both sides of the propeller around the propeller to move at least one rudder plate of them to the downstream of the propeller, and high turning performance is exerted. Further, when both rudder plates are moved to a slipstream side around the propeller until a plane vertically intersecting with a ship longitudinal axis, the complete stopping action can be provided. In this regard, since two rudders are independently steering-controlled by the electric servomotor mechanism or the hydraulic motor mechanism, as compared with the steering device described in the first part, soft control is possible, a degree of freedom of ship handling is enhanced, and the effect of providing the finer turning function is obtained.

In the present invention, the steering device, in which two rudder plates are arranged on both sides of the propeller at the ahead condition of the ship, the length of two rudder plates are configured so as to locate the leading edges of the two rudders are protruding ahead of the propeller plane in a bow direction, and the preferred action of straightening a propeller water stream is exhibited, and in this case, two rudders provide the function of straightening a water stream flowing into the propeller by interaction thereof to enhance propulsive performance of the propeller. In a system of simply positioning the rudder forward away from the propeller in order to exclude a steering portion resistance force generated from a propeller slip stream, such straightening action is not obtained. The effect given by the rudder in connection with the present invention is different in principle from effect of the straightened stream generating function by the rudder of propeller slipstream arrangement. According to the steering device in this case, two rudder plates are arranged on both sides of the propeller at the ahead condition of the ship, and the length of two rudder plates are configured so as to locate the leading edges of two rudders are protruding ahead of the propeller plane in a bow direction. In such configuration, there is the effect of suppressing turbulence of a, water inflow into the propeller caused by a region sandwiched by two rudder plates protruding in a bow direction, imparting the straightening effect at an inlet portion, at a propeller rotation surface in a region sandwiched by two rudders, water flow is bounded and regulated, and accelerating a flow rate of the slipstream, to enhance turning performance. In a case of modification of a fuller ship aiming the larger cargo space, the flow regulation effect of the present invention is increased because the upstream flow of a propeller is not formed by enlargement of a stern shape.

In the present invention, it is preferable to characterize the steering device according to claim 1 so that two rudder plates are arranged on both sides of the propeller at the ahead condition of the ship, the length of two rudder plates are configured so as to locate the leading edges of two rudders are protruding ahead of the propeller plane in a bow direction, and the action of straightening a propeller slip stream is exhibited, and in this case, two rudder plates improve propulsive efficiency by flow regulation effect on an outlet flow of a propeller and turning performance by accelerating flow at the same time, when two rudder plates are arranged on both sides of the propeller at the ahead condition of the ship, the length of two rudder plates are configured so as to locate the leading edges of two rudders are protruding ahead of the propeller plane in a bow direction.

The steering device, wherein both of two rudder plates face each other across the propeller, and can turn simultaneously around the propeller in the same direction.

Operational Advantage of the Invention

According to the steering device, both of two rudder plates face each other across the propeller, and turn simultaneously around the propeller in the same direction. Two propellers become simple such as the same motion, and there is an advantage that ship handling becomes easy. When a ship is faced in the right direction, the rudder on the right side is turned counterclockwise in front of the propeller, and the rudder on the left side is turned counterclockwise similarly behind the propeller, hence a deflected water stream as an azimuthing thruster is generated, consequently the advantage of excellent maneuverability can be obtained.

The steering device, wherein two rudder plates can turn simultaneously in the same rotation direction, and can turn simultaneously in a direction opposite to each other, while both face each other across the propeller.

Operational Advantage of the Invention

According to the steering device, two rudder plates can turn simultaneously in the same rotational direction, and can turn simultaneously in a direction opposite to each other, while both face each other across the propeller. Each rudder can rotate around its own steering shaft, independent from each other. In this case, like the invention described in the present claim, not only high turning performance such as a deflected water flow induced by a thruster, but also the maximum stopping ability can be provided, if both of them face with the propeller at the same time, and rotate simultaneously around the propeller in the same direction, or if both can constitute a plane intersecting vertically behind the propeller at stopping motion. By a free rotating mechanism around the steering shaft, this stopping motion is realized. In order to make this stopping action work more effectively, smaller distances between two rudder plates and a rear end of the propeller are better. In the steering device, since the number of steering shafts is 2, and a dedicated steering shaft is disposed for two rudder plates, when the rudder plate is turned around the propeller, a turning radius can be reduced, distances between two rudder plates and a rear end of the propeller are made to be close, and the effect of enhancing the stopping ability is exerted.

The steering device, wherein a rudder angle range exceeds 70 degree, and two rudder plates cooperate to almost block a propeller slipstream.

Operational Advantage of the Invention

When a structure that rotation of an electric servomotor mechanism or a hydraulic motor mechanism is directly transmitted to the rudder via a bevel gear or without via a gear so as to freely rotate is adopted, a movable range is increased, and it becomes possible to apply a large rudder angle. By turning the rudder plate around the propeller, to apply a large rudder angle in a range of a total 180 degree or more of each rudder to turn to left and right 90 degree, it becomes possible to utilize the rudder for stopping a ship, and it becomes possible to maintain high turning performance. According to the steering device, since two rudder plates move so as to almost block the propeller slipstream just at the back thereof at emergency stop, the effect of maximizing a stopping force is exerted. An object of steering in this case is to shorten a time when the propeller is freely rotating with its own inertia after propeller driving is reset in the case necessitating emergency stop, and to impose the reverse rotation of the propeller promptly.

The steering device, wherein the rudder plates are plate-like, and are molded into a reverse L-letter type.

Operational Advantage of the Invention

Rudder plates are suspended from the steering shaft, and when rudder plates are integrally formed (monoblock) by welding, press processing, forging processing or the like, a structure thereof becomes simple, and the advantageous effect is imparted in a point of the strength and the economical property. Integral (monoblock) molding of rudder plates into a reverse L-letter type is most simple configuration, and the most advantageous effect is imparted in a point of the strength and economical property.

The steering device, wherein the rudder plates form a camber on a surface opposite to two rudder plates to generate an advancing thrust.

Operational Advantage of the Invention

The steering device is characterized in that the rudder plate has a wing profile so as to generate a thrust for pushing a ship hull forward by the effect of a camber. By forming a camber inside a flow between two rudder plates, a thrust pushing a ship hull forward can be generated. By enlarging cambers (a distance between the mean line and chord line of a wing profile), this thrust can be increased, but since a resistance is increased simultaneously, there is an optimal camber. By increasing a front width of two rudder plates relative to a rear width, and tilting the rudder plates at 10 degree or less relative to a ship center line, the steering device is optimized.

The steering device, wherein the rudder plates are plate-like, and at least one of an upper portion or a lower portion of each of the rudder plates is canted towards a steering shaft side.

Operational Advantage of the Invention

When a part is canted towards a steering shaft side, a moment of inertia of the rudder plate around the steering shaft can be more reduced, a driving power mechanism may be smaller, and the effect of realizing energy saving of operation is imparted, as compared with the case of vertical suspension. An excessive gap between the propeller and the camber is reduced, and a thrust is maintained.

The steering device, wherein the rudder plate has a limit of a chord length which is allotted when one rudder plate is arranged at a propeller slipstream, and a wing thickness of the rudder plate is thinner than a wing thickness allotted when one rudder plate is arranged at the propeller slipstream.

Operational Advantage of the Invention

Two rudders are arranged on both sides of the propeller at the time of direct traveling, and when one rudder of twin rudder configuration has a rudder area smaller than that giving the same rudder performance by one rudder, as compared with single rudder configuration, and a chord length is smaller than that of the case of one rudder, an aspect ratio of a wing is increased to suppress a fluid resistance, and a high propulsive efficiency is obtained by a thin small rudder.

The steering device, wherein the driving mechanism can perform by freely switching each mode of two-dependent modes in which two rudder plates are turning-driven independently of each other, and a two-same direction mode in which two rudder plates are both turning-driven in the same direction.

Operational Advantage of the Invention

The invention is the steering device in which, when the driving mechanism operates, driving is enabled by dividing into two-dependent modes in which two rudders are driven independently of each other so that a sufficient steering force can be generated even at a small vessel speed, and a two-same direction mode mainly used at cruising in which two rudders are turned in the same direction. In the case where a vessel speed is reduced, since a water current speed and a discharge flow rate produced by the propeller become small, and these become insufficient for steering, the present inventors came to realize that, in a region where a vessel speed is reduced, steering is different from that at cruising. Then, according to the steering device of the present invention, in the steering device constituting the invention, a basic framework compensating for decrease in a steering power at a low speed and, at the same time, realizing improvement in steering performance and operating performance at cruising navigation is defined, as a steering category, for example, as that with a predetermined vessel speed being a boundary, at a vessel speed in a range smaller than the above vessel speed, the steering shaft can be steered in a two-independent mode in which left and right rudders have no constriction independently of each other.

At the time of a low speed or at the time of a cruising speed, by dividing a steering mode into one mode of two-independent modes or a two-same direction mode, improvement in operating performance of the present invention, the steering ability at a low vessel speed, silent navigation, and the emergency stopping ability at stoppage of a ship are used depending on the situation, and the effect depending on the situation is exerted.

The steering device, wherein in the two-independent modes, the rudder plate on a broadside opposite to a veering direction can turn from aside of the propeller to behind the propeller by rotation of the steering shaft, and simultaneously with this, or before or after this, the other rudder plate on a broadside on a veering direction side can turn from aside of the propeller to behind the propeller from a rudder angle of 90° until a rudder angle takes a rudder angle of an interference limit with other mechanism, by rotation of the steering shaft.

Operational Advantage of the Invention

According to the present steering device, the effect of generating a thrust flow to aside of a broadside in a veering direction is obtained. It is preferable that steerage of the rudder plate on a broadside opposite to a veering direction remains at a rudder angle of 45° to 55°, and other rudder plate can turn at a rudder angle from more than 90° to a limit that does not interfere with other mechanism such as the propeller and a screw shaft, for example, 105°.

A method for steering the steering device, comprising, in the two-independent mode, turning the rudder plate on a broadside opposite to a veering direction from aside of the propeller to behind of the propeller by rotation of the steering shaft, simultaneously with this, or before or after this, turning the other rudder plate on a broadside on a veering direction side from aside of the propeller to behind of the propeller from a rudder angle of 90° until a rudder angle takes a rudder angle of an interference limit with other mechanism, by rotation of the steering shaft and after turning of the two rudder plates, further, increasing the propeller rotational speed more than the propeller rotational speed at the ship condition with a straight course keeping.

Operational Advantage of the Invention

According to steering of the present invention, the effect of increasing a flow velocity laterally will enhance the steering ability. Particularly when it is desired to let the rudder work at a low vessel speed, according to the invention described in the present claim, there is obtained the effect of imparting the thruster function to the rudder without increasing a vessel speed, even when the more powerful thruster function is exerted by the function of the propeller.

Effect of the Invention

According to the present invention, at the time of straight cruising, the effect of imparting high propulsive performance so that the rudder is not positioned at the propeller slipstream is provided, and at the time of emergency stopping, a high stopping force due to a rudder angle of 90 degree relative to a ship hull at the propeller slipstream is obtained, and the excellent effect of providing a steering device which freely deflects and straightens a water stream of the propeller for turning to maintain turning performance is exerted.

According to the present invention, the further excellent effect of providing a steering device which still maintains the turning ability due to generation of a thrust flow even at low speed navigation using the present device and a method for steering the same is exerted, and further, a steering device which reduces a water cleaving noise of the rudder and a method for steering the same are provided.

MODE FOR CARRYING OUT THE INVENTION

Figure 1:
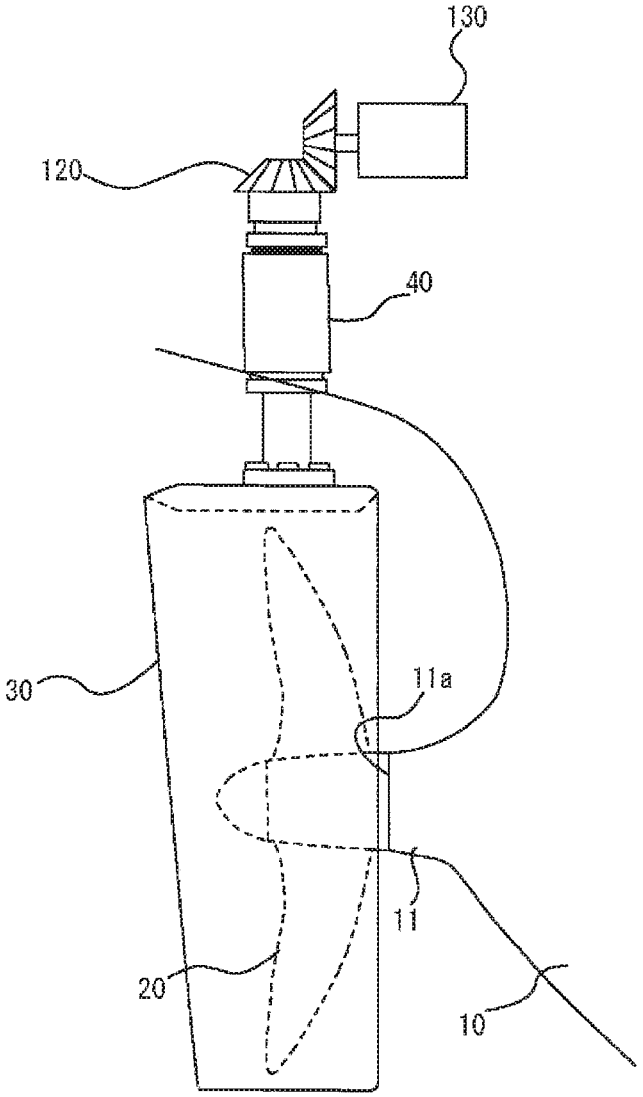
FIG. 1 A side view of a stern of a ship to which a first embodiment of the present steering device is applied.
Figure 2:
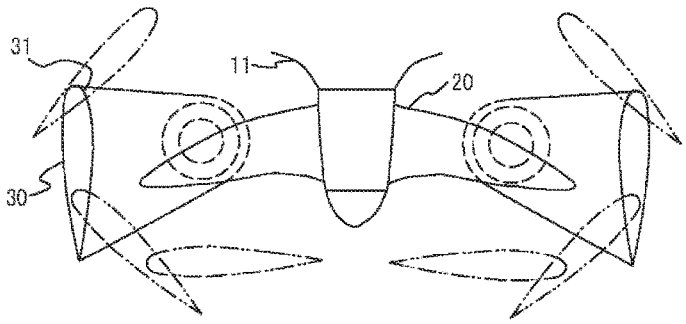
FIG. 2 A plane view of the steering device in connection with the first embodiment at the time of steering.
Figure 3:
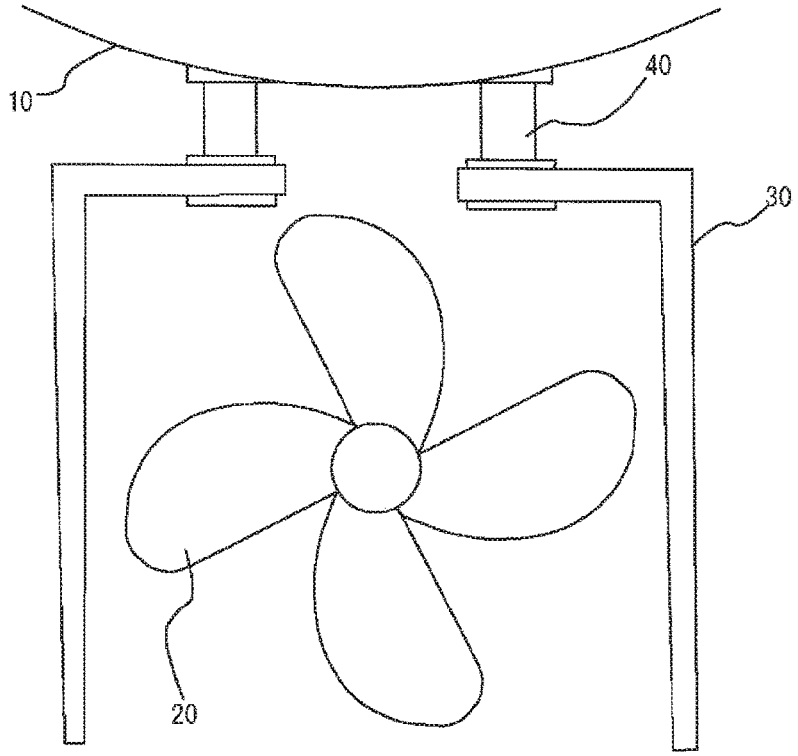
FIG. 3 A front view of the same device.
Figure 4:
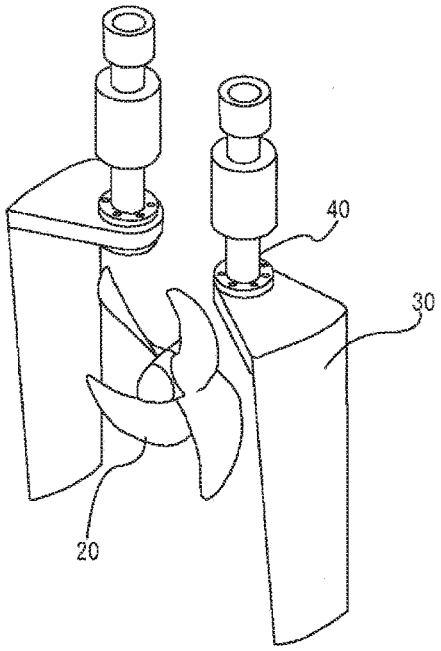
FIG. 4 A perspective of the same device.

Each embodiment of the present steering device will be illustrated below. FIG. 1 is a side view of a stern of a ship equipped with a steering device according to a first embodiment (interior of a ship is a sectional view), FIG. 2 is a vertical view of the same steering device at the time of steering, FIG. 3 is a front view of the same steering device, and FIG. 4 is a perspective of the same steering device.

A steering device according to a first embodiment comprises a propeller 20 attached to a rear end 11*a* of a stern tube 11 of a ship hull 10, two rudder plates 30, and a mechanism driving rudder plates 30 via a steering shaft 40. Two rudder plates 30 are arranged on both sides of the propeller 20. A cambered shape 31 is formed inside two rudder plates 30. The Front ends of two rudder plates extend forward of the plane formed by a propeller rotation plane. The length of this protrusion can be extended forward in such a way that it does not interfere with the ship hull 10, the length depends on a wave created by a ship hull shape 10 and an economical vessel speed, and also depends on the straightening water flow between the two rudder plates 30, a use mode such as a forward thrust generated by the camber 31 of the rudder plates 30, and the water viscous resistance. It may be optimized under these constraint conditions. The two rudder plates 30 may be also rudder plates 30 having no camber 31, and in this case aims at a low fluid resistance of the rudder plates 30 and the straightening effect on vortex generation in the vicinity of a stein.

The rudder plates 30 exhibit a reverse L-letter plate shape as shown in a front view 3, and are fixed at the steering shaft 40 which is rotatably supported by the ship bottom portion of the ship hull 10. At the time of steering; with rotation of the steering shaft 40, the rudder plates 30 turn around the propeller as shown in FIG. 2. By turning of the rudder plates 30 around the propeller as shown in FIG. 2 rather than rotation around a shaft on a plate surface. This increases the deflected flow of the propeller slipstream, and turning performance is improved.

The two rudder plates 30 have such a shape that a thrust for impelling the ship hull 10 forward is generated by the effect of the camber 31. By tilting the rudder plates 30 at 10 degree or less relative to a ship center line by making a front thickness greater than a rear thickness, the rudder plates are arranged so as to have a suitable attack angle, they have an optimal rudder plate shape having little resistance on a flow in the vicinity of the stern of the ship hull 10 while increasing a propeller efficiency, and an overall greater forward thrust can be obtained.

Figure 5:
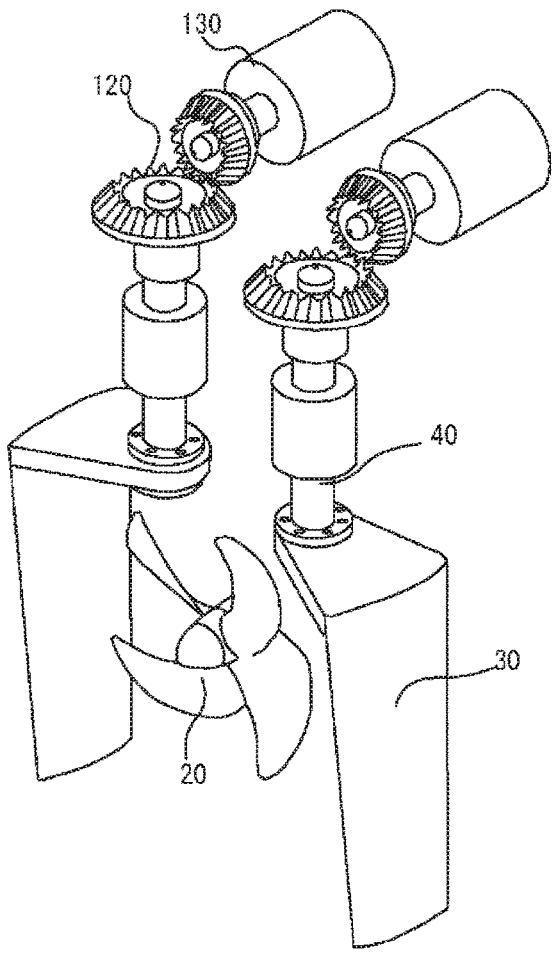
FIG. 5 A perspective of a gear driving mechanism of the same device.
Figure 10:
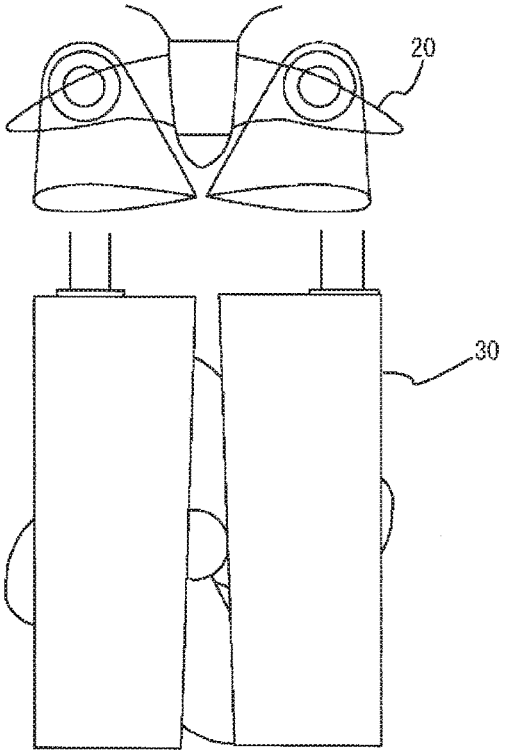
FIG. 10 A plane view/a front view of the same device at the time of stopping.

Upon rotation of the steering shaft 40 by the driving mechanism, shown in FIG. 1 and FIG. 5, each driving shaft is freely rotated using a bevel gear 120 and an electric servomotor mechanism 130. When the two rudders are turned so as to be closed simultaneously from a direction seen from a ship stein 11 of FIG. 1 toward a center, they can be positioned as shown in FIG. 2 and FIG. 10, and can be used as a brake at the time of an emergency. In addition, the electric servomotor mechanism 130 exerts the same effect in the case of a hydraulic servomotor mechanism, or a mechanism of a combination of an electric servomotor and a hydraulic servomotor.

Figure 7:
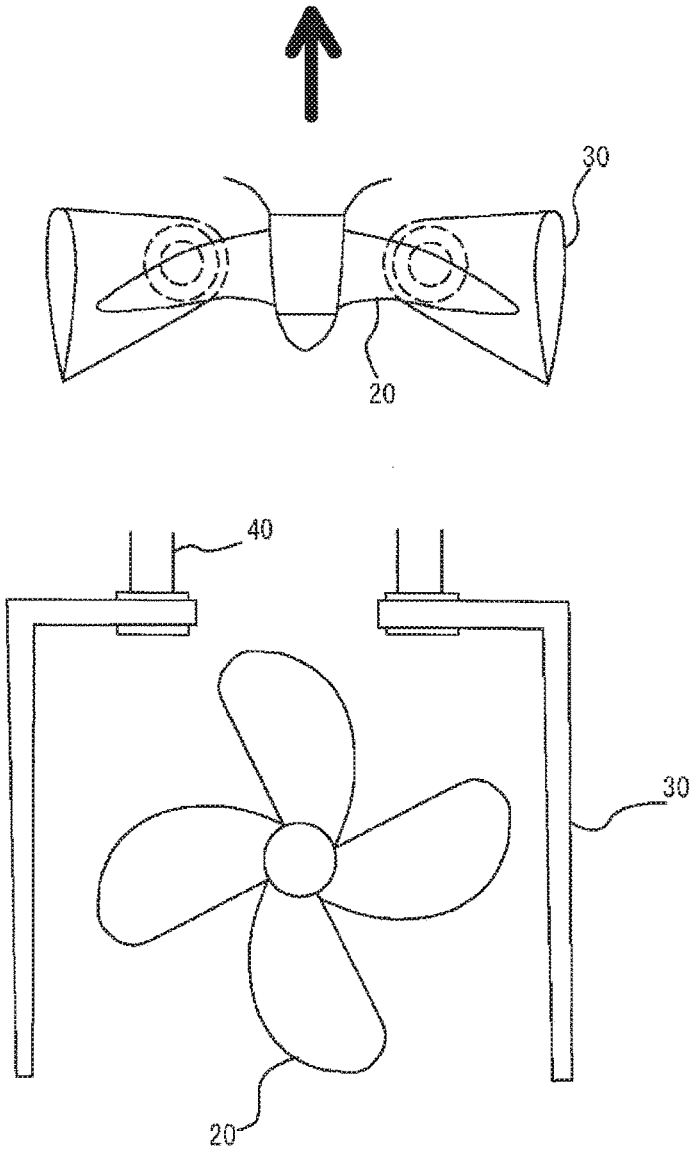
FIG. 7 A plane view/a front view of the same device at the time of direct traveling.
Figure 8:
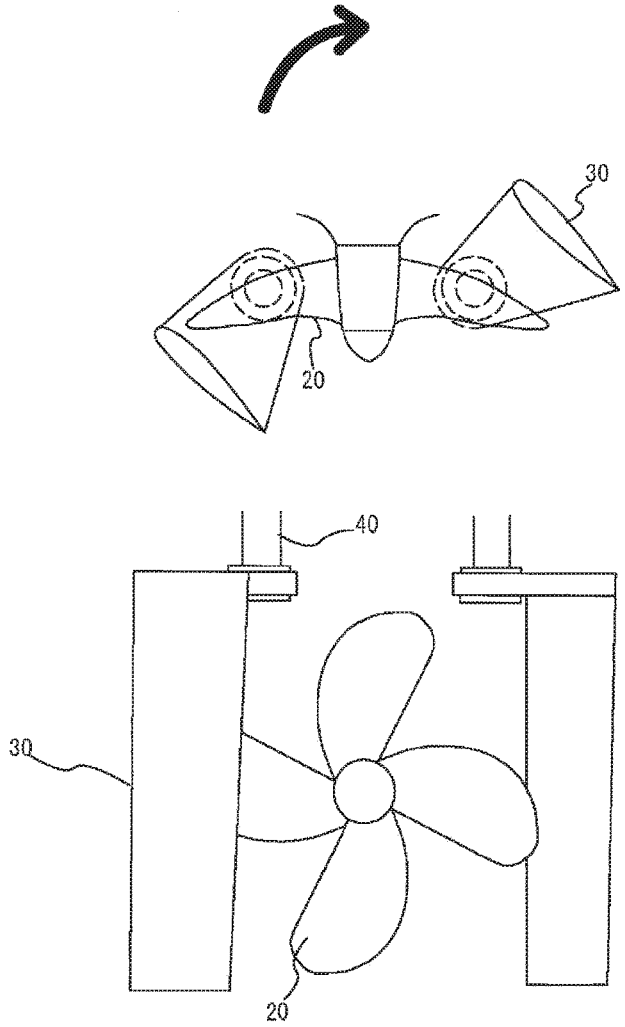
FIG. 8 A plane view/a front view of the same device at the time of starboard turning.
Figure 9:
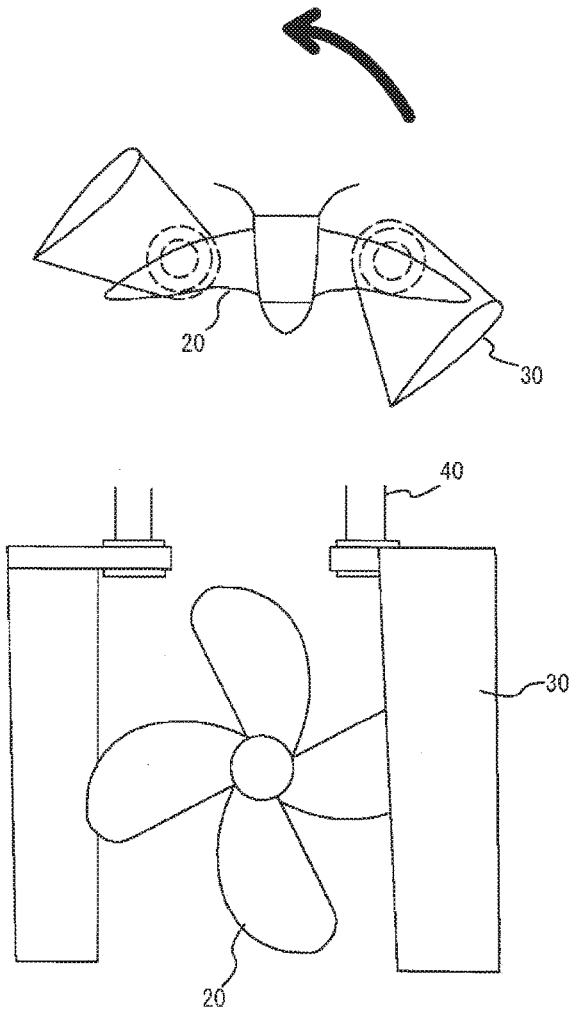
FIG. 9 A plane view/a front view of the same device at the time of larboard turning.
Figure 11:
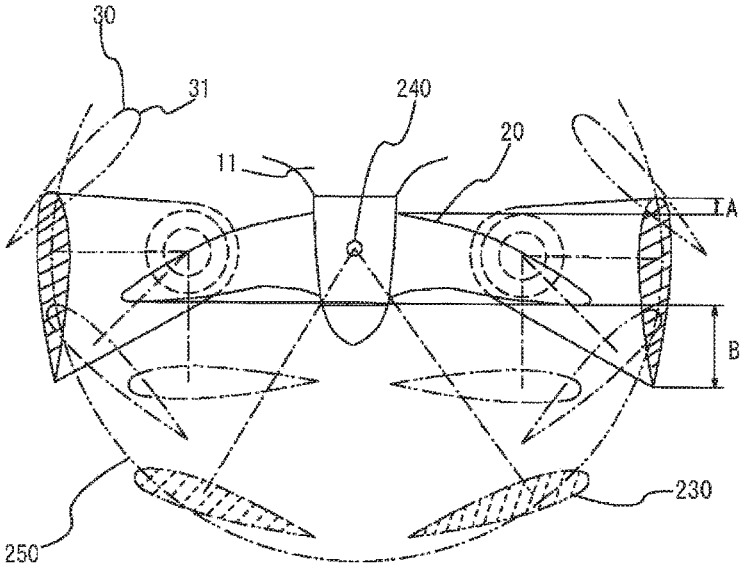
FIG. 11 A comparison view between uniaxial turning of the same device at the time of stopping.
Figure 12:
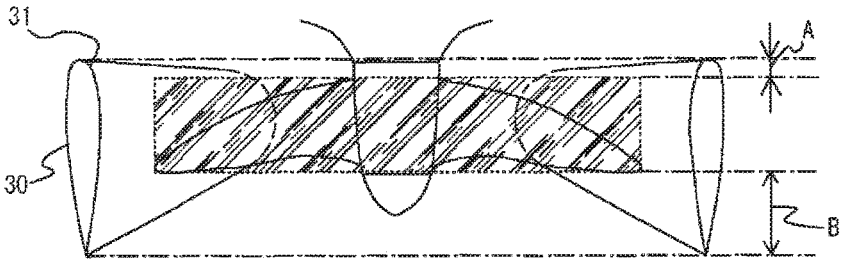
FIG. 12 An arrangement view of a rudder plate and a propeller of the same device.

FIG. 7 shows arrangement of the rudder plates 30 when travelling straight ahead, FIG. 8 shows the turning state of the rudder plates 30 at the time of right turning, FIG. 9 shows the turning state of the rudder plates 30 at the time of left turning, and FIG. 10 shows the turning state of the rudder plates 30 at the time of stopping if the two shafts can be driven independently by the driving mechanism as shown in FIG. 5, turning positions from FIG. 7 to FIG. 10 become possible, it results in a steering device which affords a high stopping force by imparting a rudder angle of 90 degree relative to the ship hull 10 by the propeller slipstream at the time of emergency stopping, while providing the effect that the rudder plates 30 are positioned on both sides of the propeller to impart a high propulsive efficiency without positioning in the propeller slipstream when straight cruising, and freely deflects and straightens a water stream of the propeller 20 in order to turn a ship, and assures good turning performance. FIG. 11 shows an possible position of a rudder plate 230 which has turned around a steering shaft 240 at the time of emergency stopping in the case where the steering shaft is uniaxial, and a possible turning arc 230 of the rudder plate in this case is additionally shown in FIG. 20. In the case of two steering shafts, since the rudder plate turning radius becomes small by each turning, when two steering shafts each have a turning mechanism, the rudder plate 230 can approach a position closer to the propeller as compared with the case of a one steering shaft, a rudder angle can approach vertically relative to a propeller screw shaft, and the braking effect can be maximized.

Figure 6A:
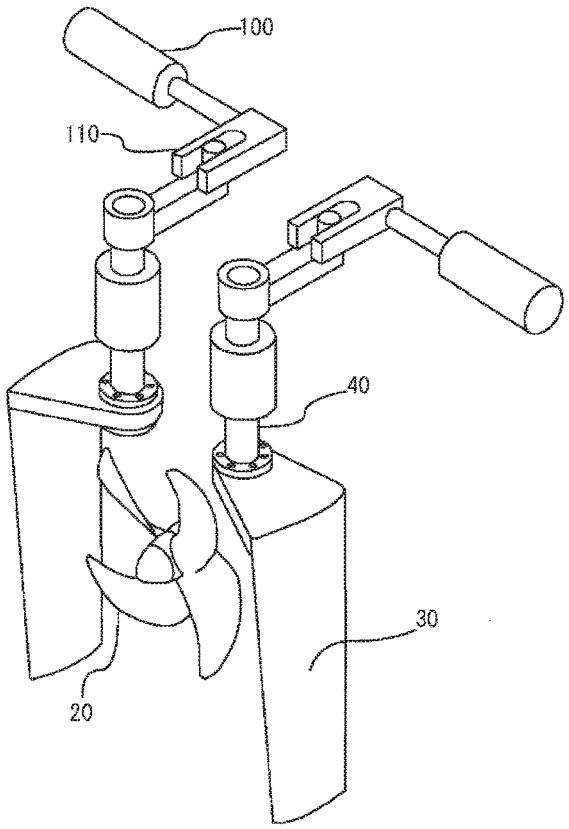
FIG. 6A A perspective of a crank driving mechanism in connection with another embodiment of a driving mechanism of the same device.

FIG. 6A and FIG. GB show other version in which the gear driving mechanism of FIG. 5 is a crank mechanism. As shown in FIG. 6A, by rotating the steering shaft 40 by a mechanism of a hydraulic cylinder 100 and a crank mechanism 110, two rudder plates 30 can be freely turned. This is an embodiment in which oil pressure is a power source, and since an oil pressure system is frequently used in a ship it can be utilized for this purpose so the driving device in connection with the present invention can be realized at a smaller cost.

Figure 6B:
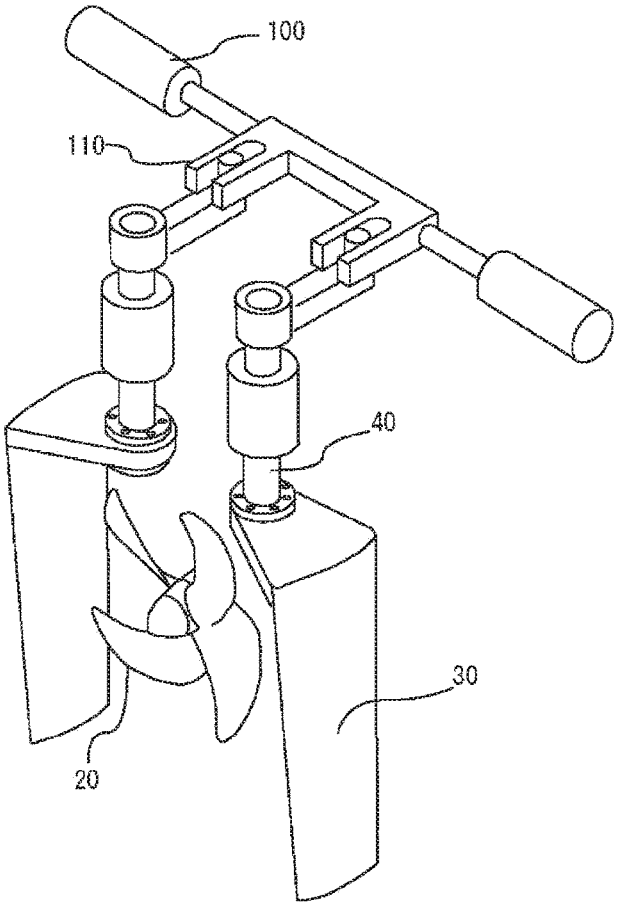
FIG. 6B A perspective of a crank driving mechanism in connection with another embodiment of a driving mechanism of the same device.

According to the steering device shown in FIG. 6B, the crank mechanisms driving two steering shafts are connected, and two steering shafts are rotated by conjunctive synchronization. A conjunctive synchronous rotation of two steering shafts by crank mechanisms has an advantage that steering becomes easy, and a steering device mechanism may be also simple. In the case of this embodiment, two rudder plates do not cooperatively make a movement so as to almost block the propeller slipstream, and increase in a stopping force in the case of sudden stop cannot be obtained, but by arranging two rudder plates on both sides of the propeller at the time of direct traveling, two effects of capable of turning rudder plates to the slipstream side of the propeller at the time of rotation of a ship while obtaining high propulsive performance, and obtaining high turning performance can be achieved.

Figure 13:
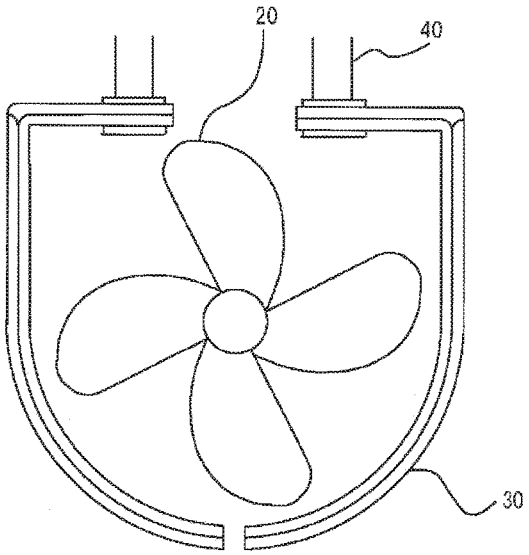
FIG. 13 A front view including a propeller at a rudder plate portion of a steering device in connection with a second embodiment (the case where a lower portion of a reverse L-letter type rudder plate includes an arc shape).
Figure 14:
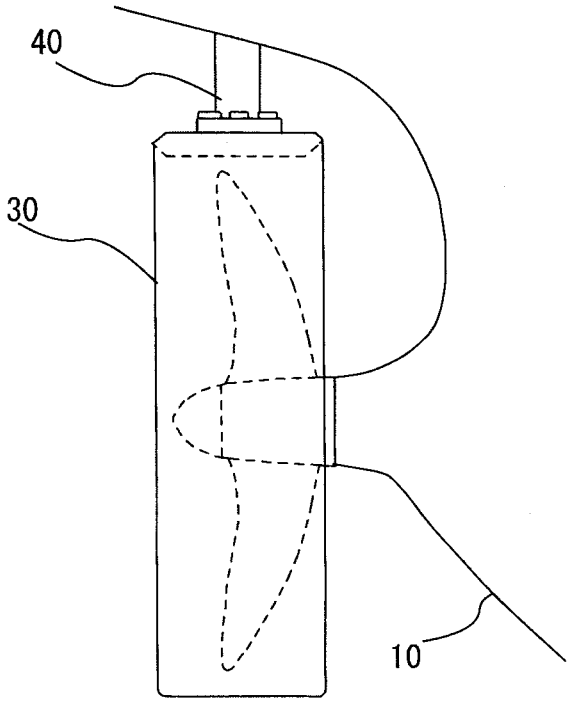
FIG. 14 A side view of the same device.
Figure 15:
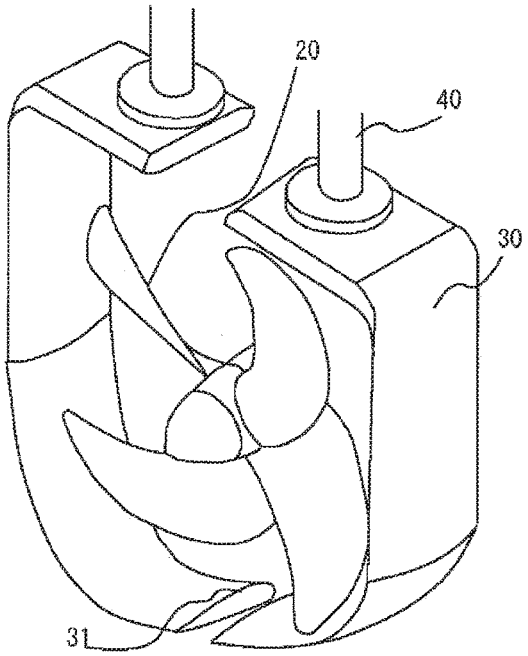
FIG. 15 A perspective of the same device.

FIG. 13 is a front view including a propeller of a rudder plate portion of a steering device in connection with a second embodiment, FIG. 14 shows a side view of the same, and FIG. 15 shows a perspective of the same. The second embodiment is different from the first embodiment in the following points.

The second embodiment is the case where an arc shape is included at a lower portion of the reverse L-letter type rudder plate of the first embodiment, and provides the effect of realizing the effect imparted by the first embodiment by requiring a smaller steering device driving mechanism. The second embodiment will be illustrated below.

In the second embodiment, a steering shaft 40 from which a rudder plate 30 is suspended, is arranged laterally from a center of a propeller 20 at a distance D, and is fixed on a ship bottom 10. Herein, D is a numerical value smaller than a propeller radius R. An upper portion of the rudder plate 30 is constructed into a reverse L-letter type, and the rudder plate 30 suspended from the ship bottom 10 is isolated from the steering shaft, center by $R-D+\alpha$. $\alpha$ is a gap between a propeller rotation radius and the rudder plate. A central portion of the rudder plate 30, that is, a portion lower than a horizontal line passing through a propeller center shaft is a ¼ arc, and is configured to be slightly isolated from, and opposite to the rudder plate which is similarly suspended from an opposite steering shaft. Herein, parameters of R, D and $\alpha$ are optimally designed in view of various elements such as propeller performance, rudder performance, a ship type and the like.

In order to turn the reverse L-letter type rudder plate 30 around the steering shaft 40 with a horizontal portion of a L-letter type being an arm, the rotational inertia moment becomes great in proportion to a length of an arm to be turned, as compared with the case where the portion is rotated around the steering shaft in a form of inclusion of the steering shaft in a rudder plate surface in the conventional steering device. Then, as a power device driving the steering shaft, a larger shaft than before becomes necessary, and disadvantage arises in respect of a combination with a ship type, and an economic efficiency, in some cases. Even in such a case, if it becomes possible to reduce the inertia moment as much as possible so that a smaller steering device driving power source may be used, a more preferable steering device excellent in energy saving and an operational efficiency can be provided. Herein, since the inertia moment I of a mass point in at a distance r from a rotation center satisfies:

$$I=mr^2 \qquad \text{equation (1),}$$

concerning a portion lower than a horizontal axis line of a propeller central line of a reverse L-letter type rudder plate portion of the steering device in connection with the first embodiment shown in FIG. 3, when a part of the rudder plate is a ¼ arc shape as in FIG. 13 showing this embodiment, the distance from the steering shaft rotation center is reduced and, therefore, the inertia moment is reduced in proportion to the square thereof.

Since a necessary driving force is in proportion to the inertia moment, and a driving energy is also in proportion to the inertia moment, in the steering device in accordance with the second embodiment shown in FIG. 13, it results in that a smaller power mechanism is enough, and energy saving is realized. Energy saving is one object of the present invention, and this satisfies the aims of the invention.

In the second embodiment, a camber 31 is formed on a surface opposite to two rudder plates, that is, inside the rudder plates (FIG. 15). The camber aims at improving propulsive performance by a thrust generated by the wing shape. Although the camber 31 is also formed in the first embodiment, in the rudder plate of the steering device in accordance with the second embodiment, by making a rudder plate lower portion of a reverse L-letter type a ¼ arc shape, the rudder plate becomes closer to the propeller, and since a water flow velocity in the vicinity of the camber is increased, the secondary effect that a thrust becomes greater, as it would with a fixed nozzle and an improvement in propulsive performance is greater can be expected.

Figure 16:
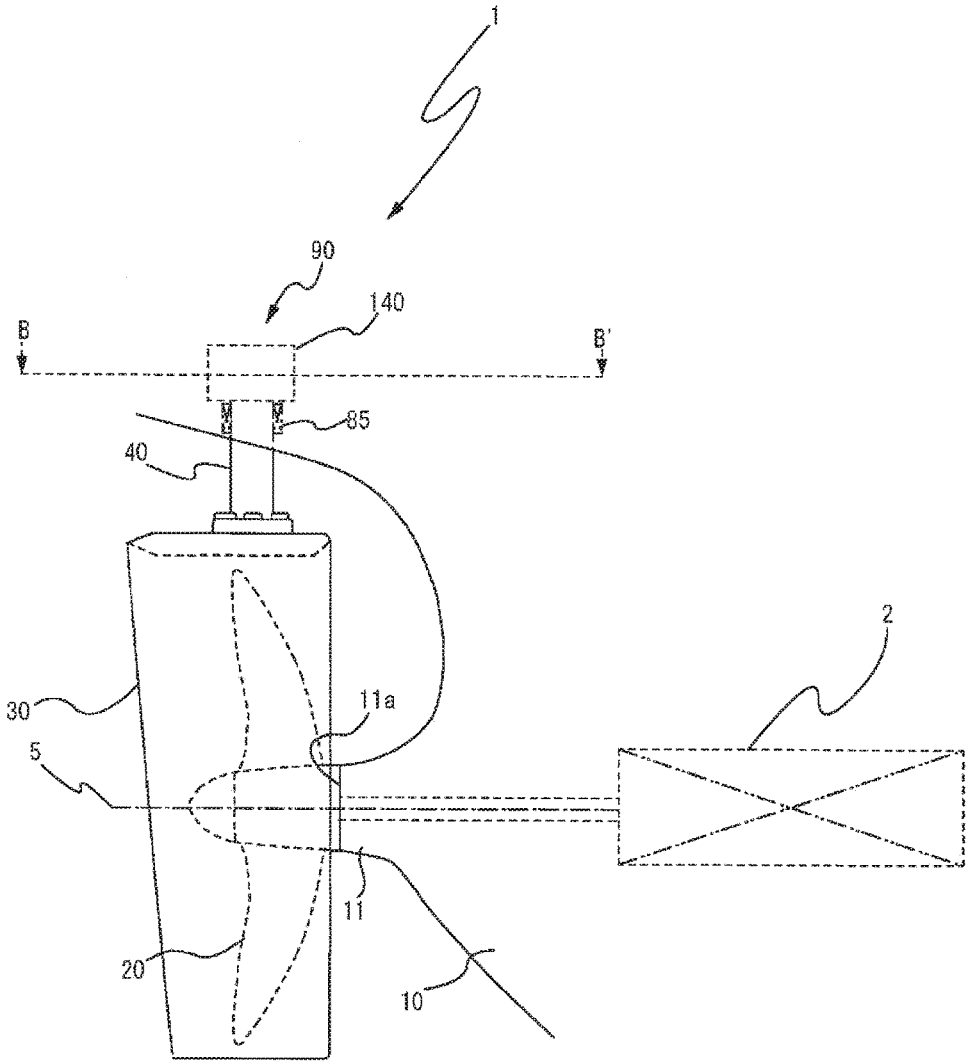
FIG. 16 A side schematic view of a stein of a ship using a steering device in connection with a third embodiment.
Figure 17:
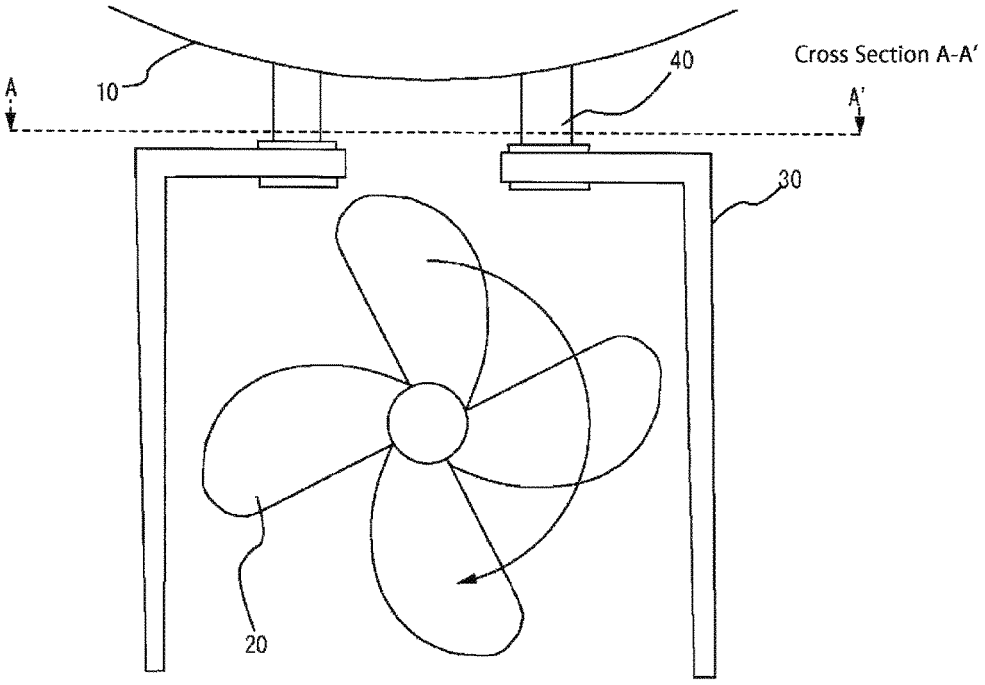
FIG. 17 A front schematic view of a rudder and a steering shaft of the same device.
Figure 18:
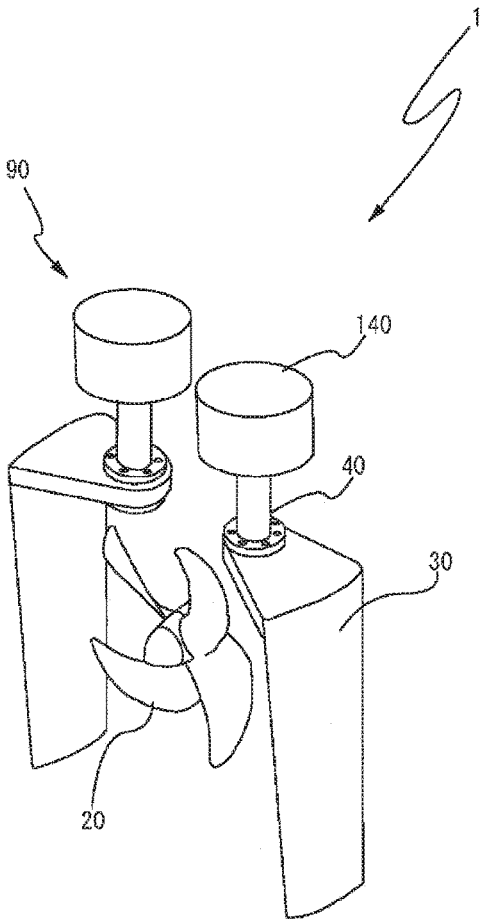
FIG. 18 A perspective schematic view of a rudder and a steering shaft of the same device.

Then, a third embodiment of the steering device will be illustrated. FIG. 16 is a side view of a stern of a ship equipped with the steering device in accordance with the third embodiment (the interior of a ship is shown by a sectional view), FIG. 17 is a front view of the same steering device, and FIG. 18 is a schematic view of a perspective of a rudder portion of the same steering device.

Also in the third embodiment, likewise the first embodiment, the steering shafts 40 are each arranged at a distance D smaller than a radius R of a propeller 20 from a screw shaft center 5, a rudder plate surface of the rudder plate 30 facing the propeller 20 is vertically arranged at a positive minimum distance a from an outer edge of the propeller 20 having a radius R on a rotation plane of the propeller 20, and the rudder plate surface is characterized in that a turning radius is defined by a distance in which a radius r is represented by the following equation:

$$r=R-D+\alpha(>0;R>D,\alpha>0) \qquad \text{equation (1)}$$

from aside of the propeller 20 to a slipstream side of the propeller 20 by rotation of two steering shafts 40, the rudder plate surface is turned at a radius r from aside of the propeller to be downstream of the propeller by rotation of the steering shaft, the rudder is placed on both sides of the propeller, two rudders each have the steering shaft, the steering shaft is attached off-center inside the rudder plate, and each steering shaft rotates independently. This configuration defines that a rudder face of the rudder plate forms a face isolated from the steering shaft, and a rotation axis by the steering shaft is not present in line with the rudder face, and makes the meaning of turning clear and, at the same time, defines that the rudder plate is positioned laterally isolated at a distance a from the propeller rotation surface outer edge. The steering shaft has a more compact configuration that it is arranged on an inner side than a propeller radius, and makes clear a difference between rudder plate arrangement of the conventional steering device of two rudders (see FIG. 2 of Patent Literature 1). That is, this is a preferable embodiment in a point that a turning radius is reduced, a turning moment of the rudder plate can be reduced in proportion to the square of a turning radius r, and it becomes possible to miniaturize a driving mechanism and a power mechanism, and consequently, this leads to energy saving which is an object of the present invention.

In this way, concerning definition between parameters, even when a turning radius r is more reduced, if a chord length of one rudder plate is a sufficient length for covering a propeller radius R, it is preferable that the turning radius r is around a half of the propeller radius R, a size of one rudder plate is defined from a relationship with a turning radius of the rudder plate in view of a chord length of the rudder plate covering the propeller radius R, and as a result, harmonization with reduction in the turning moment of the propeller is obtained, being preferable.

The size of two rudder plates which are arranged on both sides of the propeller is such that one rudder plate of twin rudder configuration can be reduced compared to the rudder area which imparts the same performance of a single rudder. When a height of the rudder is the same, that is, conceptually, a rudder width in a vessel axis direction, a chord length in the case of a wing can be smaller than that of single rudder, and in this case, an aspect ratio of a wing becomes greater. Since the wing having a greater aspect ratio suppresses reduction in a lift force and increase in a fluid resistance due to wraparound from a wing end, a small rudder satisfies a required specification, a width of the rudder is reduced, a rudder face which merely undergoes a small fluid viscous resistance is formed, and a high propulsive efficiency is obtained at the time of cruising, as compared with single rudder which imparts the same rudder performance.

Figure 19:
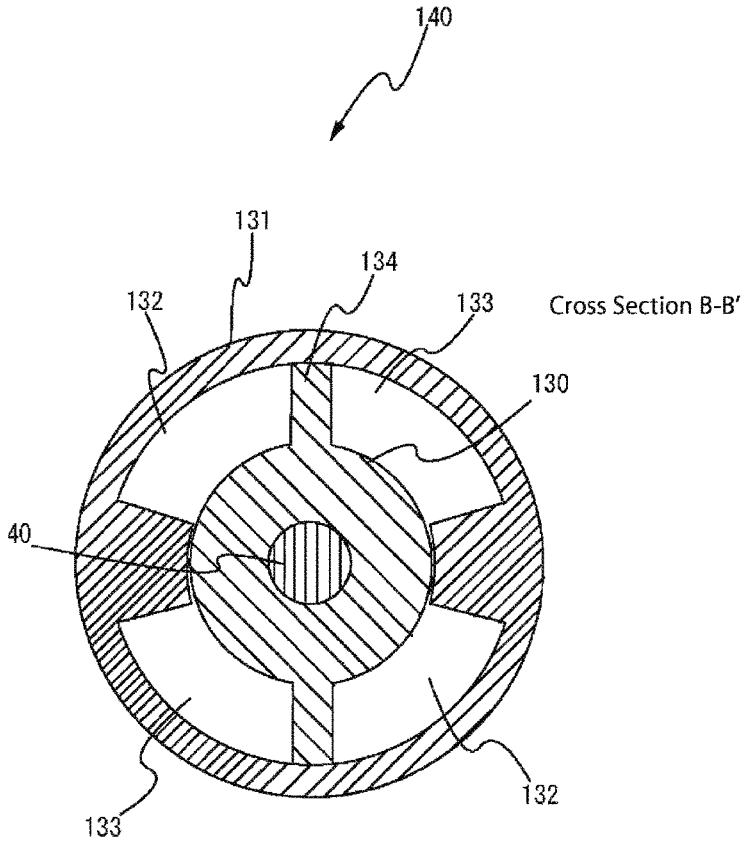
FIG. 19 A horizontal sectional B-B schematic view of a driving mechanism of the same device.

Upon rotation of a steering shaft 40 by a driving/power mechanism 90, the steering shaft 40 is directly rotated by a rotary vane-type hydraulic motor 140 (see FIG. 18). This results in that two rudder plates 30 freely turn around the propeller 20. That is, as shown in a sectional view of a driving mechanism shown in FIG. 19, when a hydraulic oil is supplied into hydraulic chambers 132, 133 which are partitioned with a vane 134 of a vane-type hydraulic motor 140 by a power mechanism, the differential force works on the vane 134 due to a pressure difference between left and right hydraulic chambers 132, 133 partitioned by the vane, and a rotor 130 is differentially operated. It results in that the steering shaft 40 directly connected to the rotor 130 freely turns the rudder plate 30 connected to the steering shaft 40.

In hydraulic chambers 132, 133, a part of a semi-cylindrical space is partitioned with the vane 134, and since the vane partitioning this can be rotated in a range of approximately 180°, a range exceeding 90°, for example, a wide rudder angle range can be supported.

According to the third embodiment as stated above, the power mechanism of the driving mechanism is a vane-type hydraulic motor mechanism 140, this is directly bound to the steering shaft 40 as a dedicated mechanism for each steering shaft 40, and when rudder plates 30 are turned towards a center from a direction seen from a stern 11 of FIG. 16 so as to be closed simultaneously, two rudders can be also emergency-braked at the time of emergency as in FIG. 10, rudder plates can be positioned at a slipstream at more than 90° up to maximally 105°, and a breaking power can be maximized. In addition, the driving mechanism 90 may be any mechanism as far as it is a separate power mechanism and driving mechanism 90 which can independently drive two steering shafts 40 freely, and may directly drive the steering shafts 40 using an electric servomotor mechanism as a power source, or may drive the steering shafts 40 via a speed reduction mechanism, and if necessary, vertical/horizontal plane conversion of a rotating plane may be performed depending on arrangement configuration of each instrument.

When the driving mechanism 90 is driven, it is preferable that the steering shaft can be steered by switching into at least two steering modes of a two-independent mode and a two-same direction mode. Hereinafter, according to a steering mode, motion of the rudder plate in the third embodiment will be illustrated using schematic views of a plane view/a front view of FIG. 7, FIG. 8, FIG. 20 and FIG. 21. A mechanism and a steering method appropriate to steering property of the steering mode are as follows.

At the time of veering steering in the two-same direction mode, basically, rudders are symmetrically steered around the propeller, and in the case where a ship is faced in the right direction, when the rudder on a right side is moved counterclockwise in front of the propeller, and the rudder on a left side is turned, similarly counterclockwise at behind of the propeller, a rightward deflected slipstream (flow F shown with two-dot chain line of FIG. 20) is generated from a counter current (flow FR shown with two-dot chain line FIG. 20), and the effect of obtaining the desired steering property is exerted.

In the two-independent mode, left and right rudders are independently steered. Steering in this independent mode is determined by a person, for example, a chief navigator, or a master of a ship. For example, since when a ship speed is reduced, a current speed and a discharge flow rate generated by the propeller are reduced, and become insufficient for steering, the rudder is steered in the two-independent mode being a steering mode corresponding to ship handling at the time of a low speed. On the other hand, for example, at a cruising speed in a range greater than a predetermined ship speed, performance is maintained by steering suitable for a cruising speed according to the two-same direction mode in which left and right rudders take a rudder angle opposite to each other. Even in one steerage, this is a steering device which enables different steering by either steering mode of the two-independent mode or the two-same direction mode.

Figure 21:
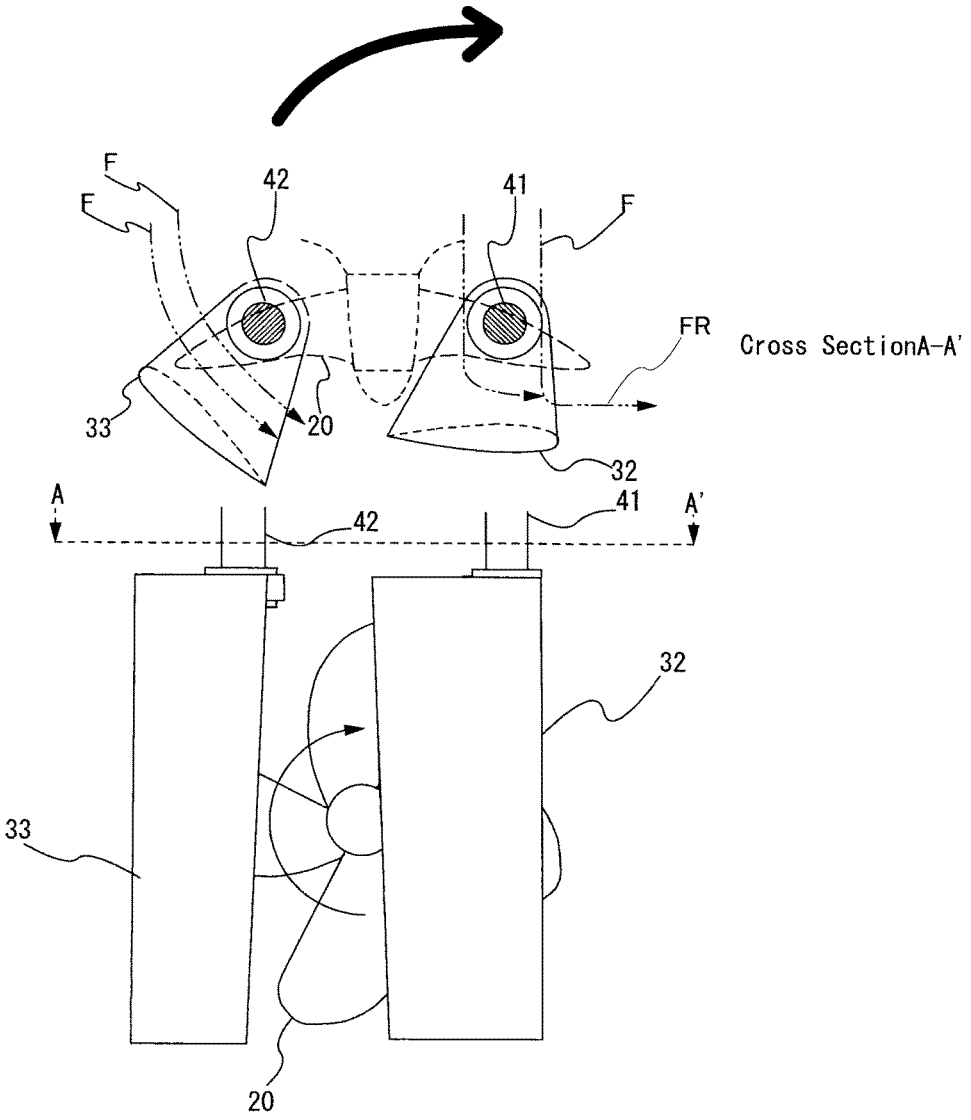
FIG. 21 A plane schematic view/a front schematic view of the same device at the time of larboard turning in a two-independent mode.

FIG. 21 shows the turning state of rudder plates 32, 33 at the time of steering in a starboard direction at the time of undocking, in which a side thrust flow is generated by the two-independent mode of the invention in connection with the third embodiment. In the two-independent mode, a rudder plate 33 on a port side opposite to a starboard veering direction is turned from aside of the propeller 20 to a downstream of the propeller by rotation of the steering shafts 42 at a first stage, and at the same time, the other rudder plate 32 on a starboard side is turned from aside of the propeller 20 to the downstream of the propeller by rotation of the steering shaft 41, the rudder plate is turning-driven so as to take a rudder angle of 90°, and jointly as a next stage, the propeller rotational speed is increased than that at the time of straight travelling.

Even in the two-independent mode, at a low ship speed region, the rotation number of the propeller is suppressed low in normal steering, and when a propeller water stream is at a low speed, since only a weak deflected flow is generated, a sufficient turning power is not obtained. Then, in the case of starboard veering ship handling generating a thrust flow in the two-independent mode, the rudder plate 33 on a port side opposite to a veering direction is turned, for example, by 45° from aside of the propeller to the downstream of the propeller by rotation of the rudder shaft 42 at a first stage and, at the same time or as a second stage, when the other rudder plate 32 on a starboard side is turned from aside of the propeller to the downstream of the propeller by rotation of the rudder shaft 41 to take a large rudder angle of 90° to 105°, a flow is concentrated from a port to a propeller central side by the rudder plate 33 which has turned by 45°, a pressure at a central portion becomes high, on the other hand, a propeller water stream which is discharged backward from a starboard right semicircle region is blocked, by the rudder plate 32 taking a rudder angle of 90°, a flow must be toward a lateral, but is pushed by a pressure near a central portion of the propeller 20, and a flow to a lateral of a starboard in a veering direction (right) is generated. Then, ship handling similar to a thruster becomes possible by discharge of a lateral flow to the just beside a veering direction. At the time of porting the helm, left and right are inverted.

Meanwhile, since almost all of a propeller water stream flows laterally, even when the propeller rotational speed is increased, a forward vessel speed is not much increased. On the other hand, when the propeller rotational speed is increased, since a water stream flowing laterally becomes fast, and a flow rate is also increased, a ship control force in the transverse direction is dramatically enhanced. That is, when veering steering in a two-independent mode is performed, as a third stage, the effect of dramatically enhancing the steering ability by increasing the rotation number of the propeller 20 is obtained. In this case, even when the propeller rotational speed is increased, a speed of a ship is not increased, and the rudder works as a thruster.

Figure 20:
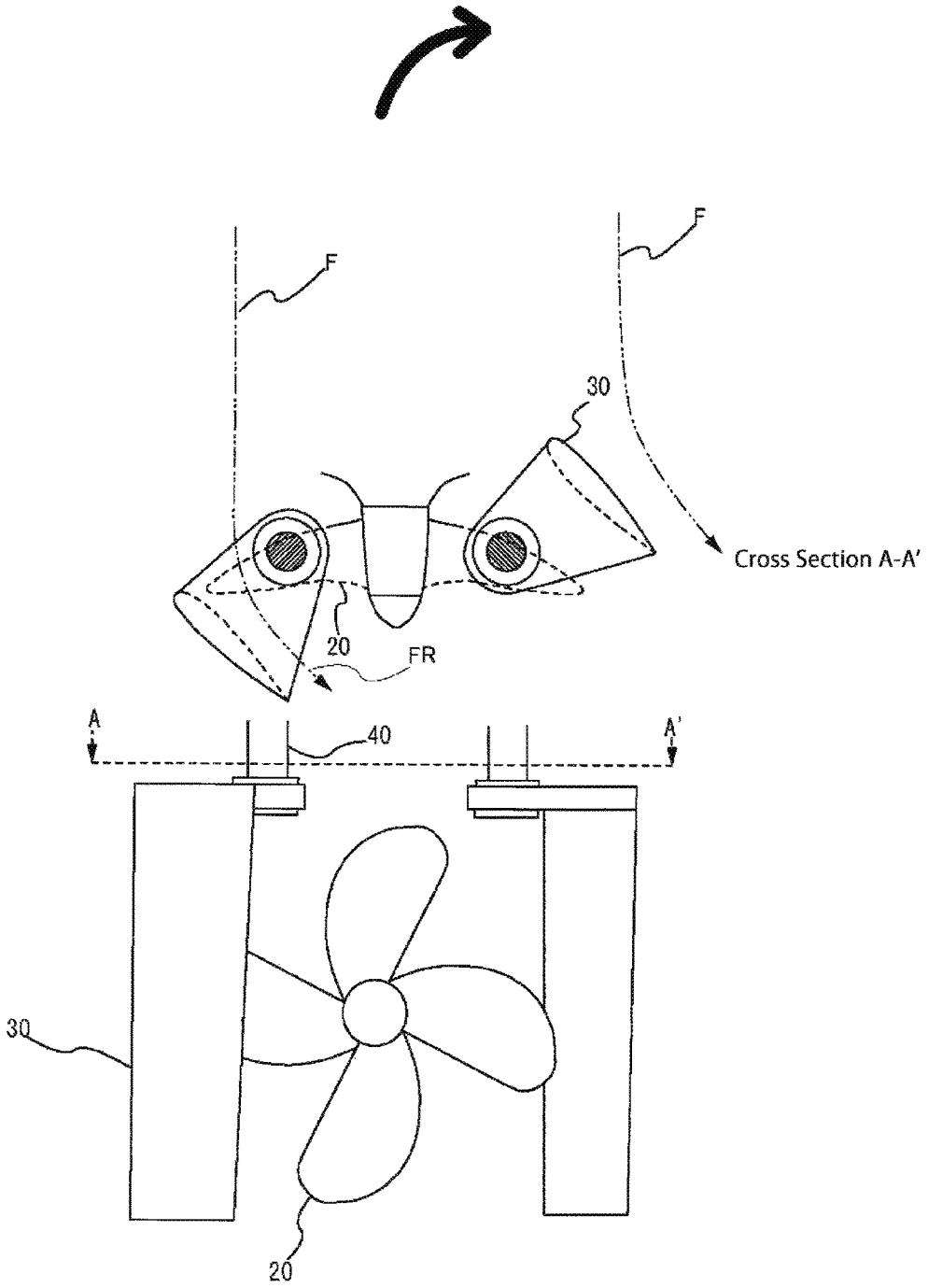
FIG. 20 A plane schematic view/a front schematic view of the same device at the time of starboard turning in a two-same direction mode.

At the time of veering in the two-same direction mode, the rudder plate on a side opposite to a veering direction is turned from aside of the propeller to the downstream of the propeller by rotation of the rudder shaft, and selectively, the other rudder plate is turned from aside of the propeller to the propeller upstream side by rotation of the other rudder shaft. FIG. 20 shows the turning state of the rudder plate 30 at the time of the two-same direction mode: starboard turning, and motion becomes left and right inversion to this at the time of porting the helm. In this case, as shown in FIG. 20, there is an advantage that, when both of the two rudder plates 30 face each other across the propeller 20, and are turned around the propeller 20 in the same direction, two propellers take the same motion, becoming simple, and ship handling becomes easy. When a ship is faced in the right direction, the rudder on a right side is moved counterclockwise in front of the propeller, and the rudder on a left side is turned counterclockwise similarly at behind of the propeller, thereby, a deflected water stream in a rudder angle direction can be generated, and the ship is turned in a rudder angle direction by the counteraction.

At the time of veering in the two-same direction mode, the rudder plate on a side opposite to a veering direction, for example, in the case of starboard helm, the port side rudder is turned from aside of the propeller to the downstream of the propeller by rotating the rudder shaft of a port side, and in the case of portside helm, the starboard side rudder is turned from aside of the propeller to the up steam of the propeller by rotating the rudder shaft of a starboard side, deflects a propeller slipstream along a large rudder angle, provides high turning performance by a rudder force due to a counterforce. In this case, the rudder force contribute to steering performance by adding the turning moment to the ship because the rudder is positioned sufficiently isolated from a ship center line. Selectively, the other rudder plate is turned upstream of the propeller from aside of the propeller by rotating the rudder shaft, the rudder plate is arranged at a position sufficiently isolated from the ship center line as compared with a conventional rudder, and turning of one rudder plate in front of the propeller imparts the maneuverability by a counterforce received from a water stream along the vessel, and another rudder plate turning behind the propeller changes a direction of a water stream of the propeller slipstream to contribute the ship turning ability. Since the rudder is located at a position sufficiently isolated from the ship center line, the present steering device provides the rudder force which contribute to steering performance by adding the turning moment to the ship.

At the ahead condition of the ship with the two-same direction rudder plate mode, both rudder plates are arranged at aside of the propeller. Since the resistance component, which is originated from a rudder behind a propeller, can be eliminated, the propulsive efficiency of a ship is increased, and higher propulsive performance can be provided compared with ship with a rudder located in a behind of a propeller. FIG. 7 shows the steering mode of the rudder in the case of ahead going. Regardless of a steering mode, at the ahead condition of the ship, the rudder plate is arranged like the rudder plate 30 shown in FIG. 7. An upward bald arrow shows a steering direction of a ship, and an upward fine arrow of a one-dot chain line schematically indicates flow of water. That is, in the case of straight course keeping ship handling, the two rudder plates 30 are retained laterally on both sides of the propeller 20. At the ahead condition of a ship, two rudders are maintained on both sides of the propeller parallel with a ship axis. Since a propeller water stream is not obstructed by the rudders, a rudder drag receiving from the flow is reduced as compared with existing two rudders arrangement behind the propeller, and higher propulsive performance can be provided. In this case, since the rudder is not placed in a high speed rotation flow of the propeller slipstream, a noise emitted from the propeller and rudder can be eliminated, and the additional effect of enabling calm cruising is also obtained, and this effect is suitable, particularly, for patrol boats, and military ships.

In stop maneuver, when the propeller is stopped, at a next stage, a rudder angle exceeding 70 degree is taken in the two-independent mode, and the two rudder plates cooperate to almost block the propeller slipstream. Selectively; thereafter, the propeller may be reversed. Herein, taking a rudder angle exceeding 70 degree is preferably to take a rudder angle of 90°, or a rudder angle of up to 105 degree exceeding this, In rudder plate arrangement shown in FIG. 10, at the time of emergency stop, two rudder plates almost block the propeller slipstream near the back of it to maximize a stopping power. An object of this steering is to reset propeller driving, and thereafter, shorten the time during which the propeller rotates by the inertia to enable the propeller to reversely rotate early, in the case where sudden stop is necessary. When it is necessary to reversely rotate the propeller like this, reverse rotation of the propeller can be stopped to accelerate reverse rotation of the propeller. In addition, when both rudder plates are turned to an upstream side 45° forward as a speed reducing stage at the time of initial motion of stop maneuver, both rudder plates receive a water stream at a vessel speed, and a speed of a ship can be reduced by the counterforce thereof.

When the steering device 1 in connection with the third embodiment shown in FIG. 18 is used, since two shafts each are independently driven by a hydraulic motor mechanism 140, and free turning from FIG. 20 to FIG. 21 becomes possible, it results in that there is provided the steering device 1 that, at the time of straight cruising, rudder plates 30 are positioned on both sides of the propeller 20 without positioning at the propeller slipstream, the effect of imparting a high propulsive efficiency is provided, and at the same time, at the time of emergency stopping, a rudder angle range exceeds 70 degree, the two rudder plates cooperate to turn around the propeller so as to almost block the propeller slipstream, a rudder angle, for example, of 90 degree to a ship hull 10 is imparted at the propeller slipstream to obtain a high stopping power, a water stream of the propeller 20 is freely deflected and straightened for turning a ship to maintain turning performance.

A fourth embodiment of the steering device is the case where a lower portion of the reverse L-letter type rudder plate of the third embodiment is folded to a propeller side, and a L-letter corner is also folded, and effect of realizing the effect imparted by the first embodiment by a smaller steering device driving mechanism is provided. This will be illustrated below.

Figure 22:
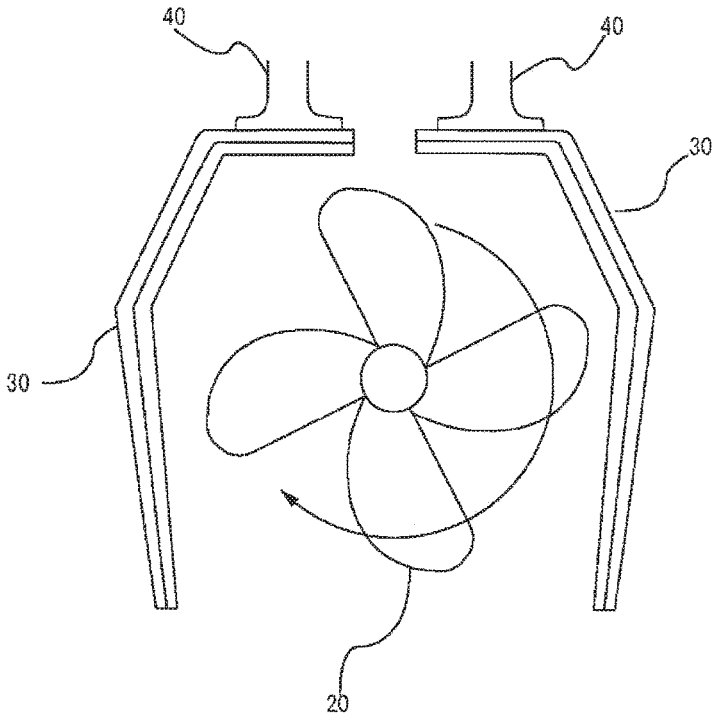
FIG. 22 A front view including a propeller of a rudder plate portion of a steering device in connection with a fourth embodiment (case where a rudder plate includes a canted portion).
Figure 23:
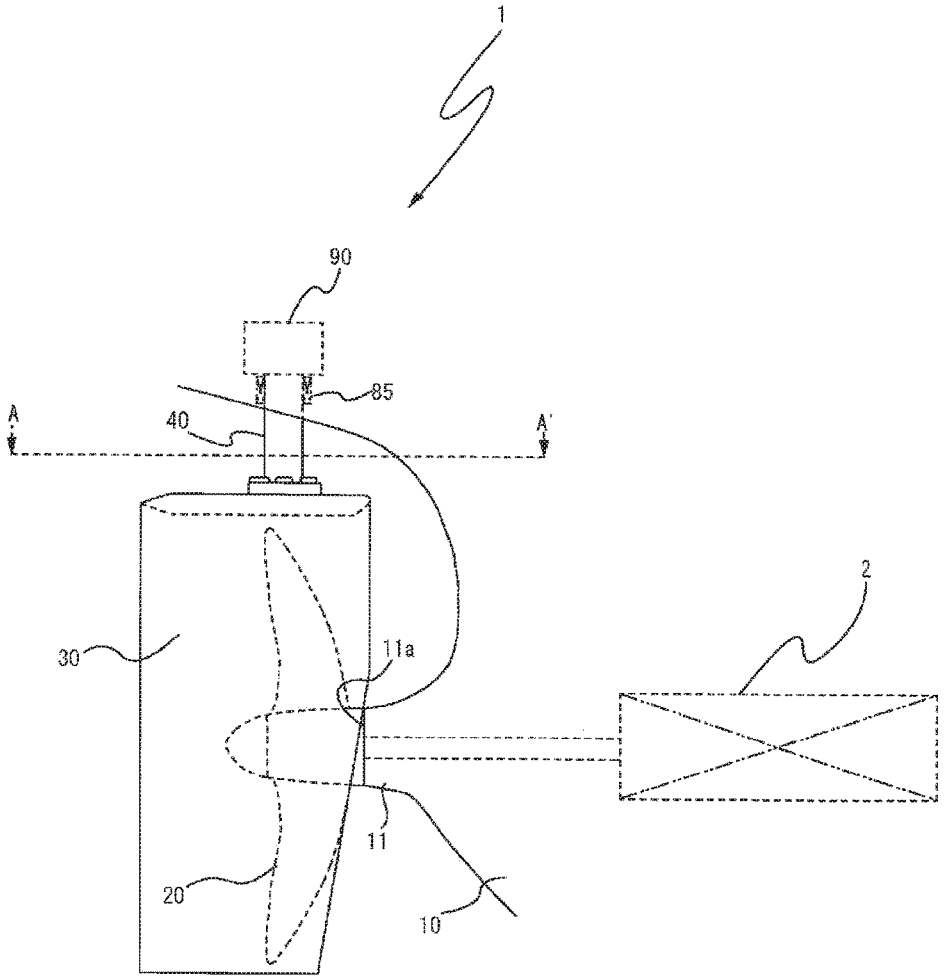
FIG. 23 A side schematic view of a stein of a ship using a steering device in connection with a fourth embodiment.
Figure 24:
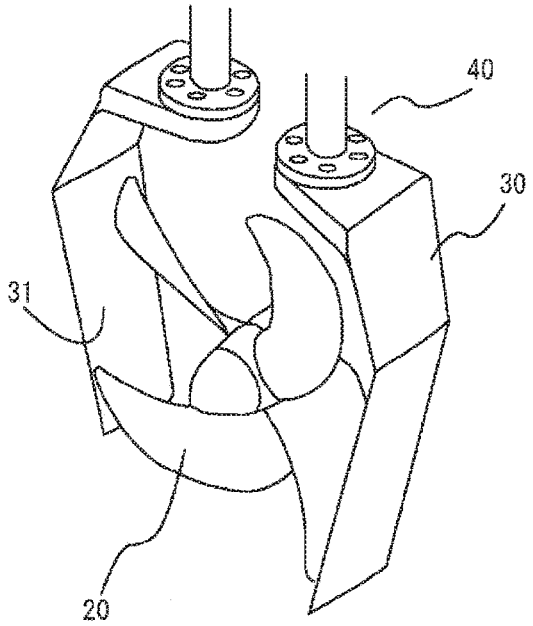
FIG. 24 A perspective of the same device.

FIG. 22 is a front view including a propeller of a rudder plate portion of the steering device in connection with the fourth embodiment, FIG. 23 is a side view of the same, and FIG. 24 shows a perspective of the same. The fourth embodiment is different from the third embodiment in the following points.

When a reverse L-letter type rudder plate 30 is attached inside off-center from the rudder shaft 40 with a horizontal portion of a L-letter type being an arm, as compared with the case of an embodiment in which it is in center of the rudder shaft in a rudder plate plane in the conventional steering device, the rotation inertia moment becomes in proportion to the square of a turning radius, a great power mechanism for driving the rudder shaft is required, and disadvantage can occur from a view point of compatibility with a ship shape, and the economy. If the inertia moment can be reduced as much as possible so that a small steering device driving power source may be used, a preferable steering device excellent in energy saving can be provided. When a lower portion of the reverse L-letter type rudder plate of the steering device in connection with the first embodiment shown in FIG. 4 is folded to a propeller side, and a mass point distance from a rudder shaft rotation center is reduced by chamfering of a L-letter corner, the inertia moment is reduced, a driving force may be a smaller motive power mechanism, and energy saving which is an object of the present invention is realized. When the rudder plate has a plate-like form similar to a reverse L-letter type like this, this is most simple configuration among a form of the rudder plate in a point of integral formation, and is most advantageous in regards of the strength and the economy. Integral formation may be by any of processing such as welding press processing, forging processing and the like, and assembling such as bolting, riveting and the like. In this case, folding has the effect of increasing rigidity, decreasing a plate thickness, and further reducing the inertia moment.

Figure 25:
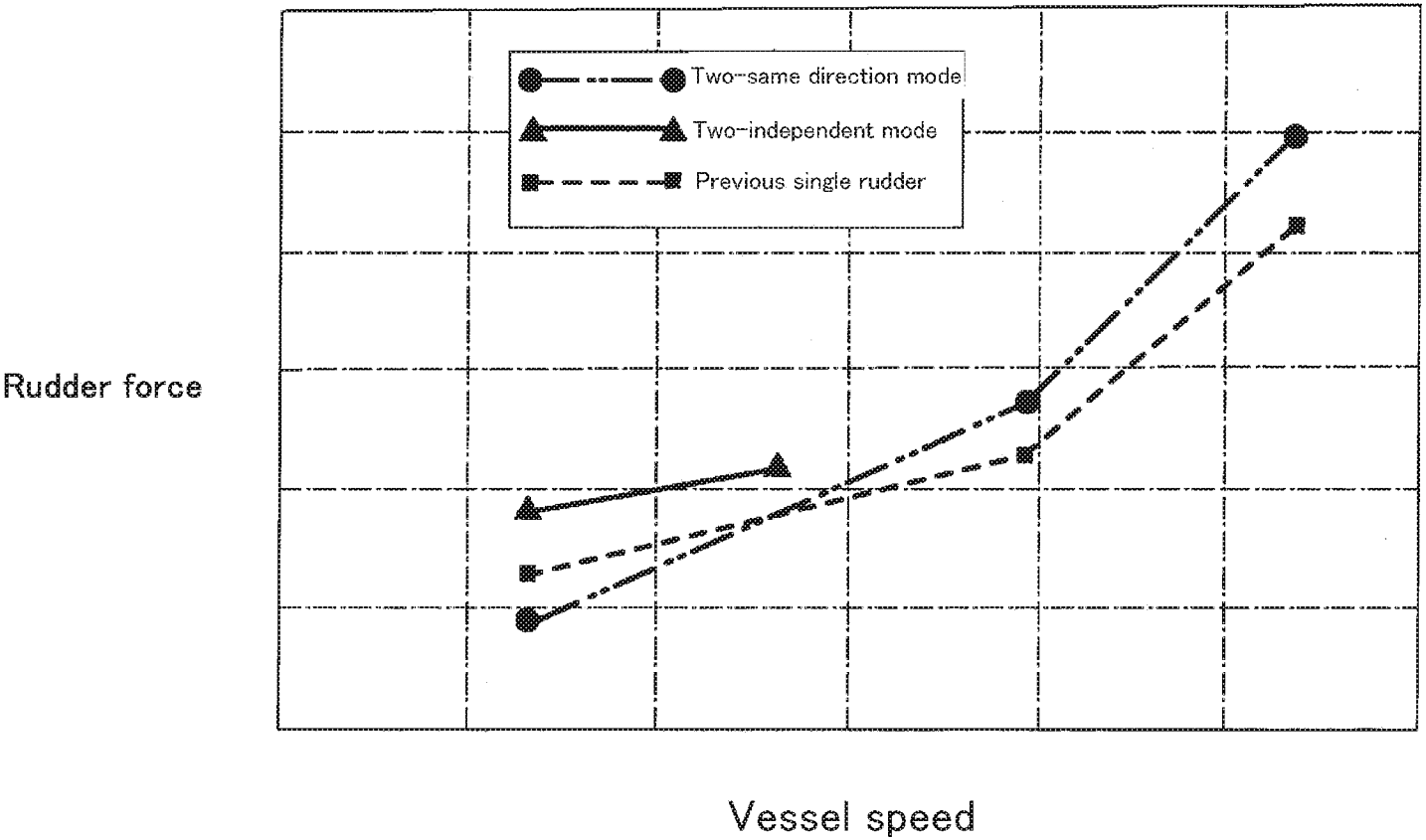
FIG. 25 A graphic view for comparing experimental, result of a steering force of each of a two-independent mode/a two-same direction mode of a model steering device in connection with one embodiment of the present invention.

FIG. 25 shows a graphic view of experimental result of the steering effort of the present invention model implementation product device in the case where steering at the time of the two-independent mode of a model steering device in connection with the fourth embodiment is implemented. Based on the following specifications, a relationship between a vessel speed and a rudder force was obtained by an experimental model.

<Specifications Around Rudder of Model Steering Device, Unit mm>

Propeller radium: 2400, rudder height: 3050, chord length: 1500 at a height of 1950 or more from lower end, 1150 at a lowest end, a chord length linearly decreasing towards a lower end, maximum plate thickness: 150, steering shaft central position: 600 from ship axis center, steering shaft diameter: 340

<Result>

FIG. 25 shows a relative rudder force of a model rudder in a longitudinal axis relative to a model ship relative vessel speed in a transverse axis. It is seen that, in the two-same direction mode, the rudder force is increased by about 20% as compared with the conventional single rudder, and in the two-independent mode, the rudder force is remarkably improved by 50%, particularly, in a low speed region. Effectiveness of the present invention which changes a rudder steering method at the time of the two-same direction mode and at the time of the two-independent mode, and is provided with a driving mechanism of the rudder supporting this change is confirmed. When steering in the two-same direction mode is also implemented in a low speed region, the steering effort is inferior by 20% to the conventional model, and superiority of a steering method of particularly setting up a steering method in the two-independent mode using the device in connection with the present invention can be confirmed.

As described above, embodiments in connection with the present invention have been illustrated, but the present invention is not limited to such embodiments, and can be implemented by various modifications in such a range not departing from the gist of the present invention.

INDUSTRIAL APPLICABILITY

The present invention can be applied to a steering portion of surface ships, particularly, big ships, domestic vessels and patrol boats requiring quick ship handling even at a low speed.

DESCRIPTION OF REFERENCE NUMBERS

1 Steering device
2 Propulsive device
5 Screw shaft
10 Ship hull
11 Stern tube
12 Stern
20 Propeller
30 Rudder plate
31 Camber
40 Rudder shaft
90 Driving/Power mechanism
100 Hydraulic cylinder
110 Crank mechanism
120 Bevel gear
130 Electric servomotor mechanism or hydraulic motor mechanism
140 Rotary vane-type hydraulic motor mechanism

The invention claimed is:

1. A steering device having a driving mechanism rotating a steering shaft, and a power mechanism driving this, wherein the steering shaft is biaxially arranged rotatably to have vertical rotation axes located on both sides of a screw shaft, two rudder plates are located lateral to a propeller at the time of straight travelling, each of the two rudder plates connects to the corresponding steering shaft, each of the two rudder plates turn around the rotation axis of the corresponding steering shaft and connects to the corresponding steering shaft, while a position of center of the rudder plate is movable, and each of the two rudder plates turn at least in a range from aside of a propeller to a downstream of the propeller by rotation of the two steering shafts.

2. The steering device according to claim 1, wherein both of the two rudder plates face each other across the propeller, and turn around the propeller with a same rudder angle.

3. The steering device according to claim 2, wherein a rudder angle range exceeds 70 degrees, and the two rudder plates turn so as to almost block a propeller slipstream.

4. The steering device according to claim 1, wherein each of the rudder plates is formed into a L-letter type, where the rudder plate is extended laterally from the steering shaft and then suspended downwardly.

5. The steering device according to claim 2, wherein the rudder plates have cambers on surfaces thereof which are opposite each other.

6. The steering device according to claim 1, wherein the rudder plates have a limit of a chord length, which is allotted when one rudder plate is arranged at a propeller slipstream, and a wing thickness of the rudder plate is smaller than a wing thickness allotted when one rudder plate is arranged at the propeller slipstream.

7. The steering device according to claim 1, wherein the driving mechanism performs by freely switching each mode of a two-independent mode in which the two rudder plates are turning-driven independently of each other and a two-same direction mode in which the two rudder plates are both turning-driven in the same direction.

8. The steering device according to claim 7, wherein in the two-independent mode, the rudder plate on a broadside opposite to a veering direction is turned from aside of the propeller to behind of the propeller by rotating the steering shaft, and simultaneously with this, or before or after this, the other rudder plate on a broadside on a veering direction side is turned from aside of the propeller with a rudder angle of 90 degrees behind of the propeller.

9. A method for steering the steering device according to claim 8 comprises the two-independent modes turning the rudder plate on a broadside opposite to a veering direction from aside of the propeller to behind of the propeller by rotating the steering shaft, simultaneously with this, or before or after this, turning the other rudder plate on a broadside and veering direction side from aside of the propeller with a rudder angle of 90 degrees behind of the propeller, and after turning of the two rudder plates, further, increasing the propeller rotational speed more than the propeller rotational speed at the time of a ship condition with straight course keeping.

* * * * *